US011639818B2

(12) United States Patent
Vaisman et al.

(10) Patent No.: US 11,639,818 B2
(45) Date of Patent: May 2, 2023

(54) THERMAL MANAGEMENT SYSTEMS

(71) Applicant: Booz Allen Hamilton Inc., McLean, VA (US)

(72) Inventors: Igor Vaisman, Carmel, IN (US); Joshua Peters, Knoxville, TN (US); Kevin McMurray, Loudon, TX (US); Max Salopek, Knoxville, TN (US); Jacob Swain, Kingston, TN (US)

(73) Assignee: Booz Allen Hamilton Inc., McLean, VA (US)

( * ) Notice: Subject to any disclaimer, the term of this patent is extended or adjusted under 35 U.S.C. 154(b) by 0 days.

(21) Appl. No.: 17/849,378

(22) Filed: Jun. 24, 2022

(65) Prior Publication Data

US 2022/0412624 A1 Dec. 29, 2022

Related U.S. Application Data

(60) Provisional application No. 63/214,341, filed on Jun. 24, 2021.

(51) Int. Cl.

| | |
|---|---|
| ***F25B 49/02*** | (2006.01) |
| ***F25B 1/06*** | (2006.01) |
| ***F25B 5/04*** | (2006.01) |
| ***F25B 43/00*** | (2006.01) |
| ***F25B 41/34*** | (2021.01) |

(52) U.S. Cl.

CPC ..... *F25B 49/02* (2013.01); *F25B 1/06* (2013.01); *F25B 5/04* (2013.01); *F25B 41/34* (2021.01); *F25B 43/006* (2013.01); *F25B 2400/0403* (2013.01); *F25B 2400/16* (2013.01); *F25B 2400/19* (2013.01); *F25B 2500/17* (2013.01); *F25B 2600/2501* (2013.01)

(58) Field of Classification Search

CPC .... F25B 49/02; F25B 1/06; F25B 5/04; F25B 43/34; F25B 43/006; F25B 2400/0403; F25B 2400/16; F25B 2400/19; F25B 2500/17; F25B 2600/2501

See application file for complete search history.

(56) References Cited

U.S. PATENT DOCUMENTS

| | | | | |
|---|---|---|---|---|
| 2019/0118610 | A1 | 4/2019 | Johnston et al. | |
| 2020/0037468 | A1 | 1/2020 | Ziemba et al. | |
| 2020/0052356 | A1 | 2/2020 | Eadelson | |
| 2020/0363101 | A1 * | 11/2020 | Jansen | F25B 40/02 |

FOREIGN PATENT DOCUMENTS

JP 2010133586 A * 6/2010

OTHER PUBLICATIONS

International Search Report and Written Opinion in International Appln. No. PCT/US2022/034982, dated Oct. 5, 2022, 7 pages.

* cited by examiner

*Primary Examiner* — Kun Kai Ma
(74) *Attorney, Agent, or Firm* — Fish & Richardson P.C.

(57) ABSTRACT

A thermal management system includes a receiver configured to store a refrigerant fluid; a refrigeration system having a refrigerant fluid path that includes the receiver, and at least one evaporator disposed in the refrigerant fluid path. The refrigeration system is configured to receive the refrigerant fluid from the receiver through the refrigerant fluid path. The at least one evaporator is configured to receive the refrigerant fluid and to extract heat from at least one heat load having a specified thermal inertia that is in at least one of thermal conductive or convective contact with the at least one evaporator.

65 Claims, 11 Drawing Sheets

THERMAL MANAGEMENT SYSTEMS

CLAIM OF PRIORITY

This application claims priority under 35 U.S.C. § 119(e) to U.S. Provisional Patent Application Ser. No. 63/214,341, filed on Jun. 24, 2021, and entitled "THERMAL MANAGEMENT SYSTEMS," the entire contents of which are hereby incorporated by reference.

BACKGROUND

Refrigeration systems absorb thermal energy from heat sources operating at temperatures below the temperature of the surrounding environment and discharge thermal energy into the surrounding environment. Heat sources operating at temperatures above the surrounding environment can be naturally cooled by the surrounding if there is direct contact between the source and the environment.

Conventional refrigeration systems include a compressor, a heat rejection exchanger (i.e., a condenser), a receiver, an expansion device, and a heat absorption exchanger (i.e., an evaporator). Such systems can be used to maintain operating temperature set points for a wide variety of cooled heat sources (loads, processes, equipment, systems) thermally interacting with the evaporator. Closed-circuit refrigeration systems may pump significant amounts of absorbed thermal energy from heat sources into the surrounding environment.

In closed-circuit systems, compressors are used to compress vapor from an evaporating pressure the evaporator and to a condensing pressure in the condensers and condense the compressed vapor converting the vapor into a liquid at a temperature higher than the surrounding environment temperature. The combination of condensers and compressors can add a significant amount of weight and can consume relatively large amounts of electrical power. In general, the larger the amount of absorbed thermal energy that the system is designed to handle, the heavier the refrigeration system and the larger the amount of power consumed during operation, even when cooling of a heat source occurs over relatively short time periods.

In some cases the surrounding environment temperature can appear below the heat source temperature. The refrigeration system provides a contact via refrigerant. There may be no need to compress vapor from the evaporating to condensing pressure since condensation can happen at a pressure slightly higher or even below the evaporating pressure.

SUMMARY

In an example implementation, a thermal management system includes a receiver configured to store a refrigerant fluid; a refrigeration system having a refrigerant fluid path that includes the receiver, and at least one evaporator disposed in the refrigerant fluid path. The refrigeration system is configured to receive the refrigerant fluid from the receiver through the refrigerant fluid path. The at least one evaporator is configured to receive the refrigerant fluid and to extract heat from at least one heat load having a specified thermal inertia that is in at least one of thermal conductive or convective contact with the at least one evaporator.

An aspect combinable with the example implementation further includes a hot vapor circuit disposed to bypass a portion of the refrigeration system.

In another aspect combinable with any of the previous aspects, the refrigerant fluid path further includes a compressor having a compressor inlet and a compressor outlet; a junction having an inlet coupled to the compressor outlet, and having first and second outlets; and a condenser having a condenser inlet coupled to the first outlet of the junction, and having a condenser outlet coupled to an inlet of the receiver, the condenser configured to condense a superheated vapor at the condenser inlet by removing heat from the condensed, superheated vapor, and is bypass-able by operation of the hot vapor circuit.

In another aspect combinable with any of the previous aspects, the hot vapor circuit includes a solenoid valve.

In another aspect combinable with any of the previous aspects, the hot vapor circuit includes a solenoid valve having an inlet and an outlet; a first junction; and a second junction, with the first junction and the second junction coupling the solenoid valve into the refrigeration system.

Another aspect combinable with any of the previous aspects further includes a suction accumulator having a suction accumulator inlet and a vapor-side outlet, the suction accumulator inlet coupled to an outlet of the at least one evaporator and the vapor-side outlet coupled to the compressor inlet.

Another aspect combinable with any of the previous aspects further includes a flow control device having an inlet coupled to an outlet of the receiver and having an outlet coupled to transport refrigerant fluid from the receiver outlet to an inlet of the at least one evaporator.

In another aspect combinable with any of the previous aspects, the flow control device is an expansion valve that causes an adiabatic flash evaporation of a part of refrigerant fluid received from the receiver.

In another aspect combinable with any of the previous aspects, the second junction has an outlet coupled to an inlet of the at least one evaporator, a first inlet coupled to the outlet of the expansion valve and a second inlet coupled to the outlet of the solenoid valve.

In another aspect combinable with any of the previous aspects, the second junction has an outlet coupled to the inlet of the expansion valve, a first inlet coupled to the outlet of the receiver and a second inlet coupled to the outlet of the solenoid valve.

In another aspect combinable with any of the previous aspects, the hot vapor circuit is configured to operate to supply heat to a heat load thermally coupled to or in proximity to the at least one evaporator.

In another aspect combinable with any of the previous aspects, the refrigeration system operates in one of three modes.

In another aspect combinable with any of the previous aspects, a first mode is a heating mode, a second mode is a cooling mode, and a third mode that is a combination of heating and cooling.

In another aspect combinable with any of the previous aspects, the refrigeration system further operates in a fourth mode that is a standby mode and a fifth mode that is a pump down mode.

In another aspect combinable with any of the previous aspects, the at least one evaporator is a first evaporator.

Another aspect combinable with any of the previous aspects further includes a suction accumulator having a suction accumulator inlet and a vapor-side outlet, the suction accumulator inlet coupled to an outlet of the first evaporator and the vapor-side outlet coupled to the compressor inlet; a first expansion valve having an inlet and an outlet, with the inlet coupled to the outlet of the solenoid valve; and at least one additional evaporator having an evaporator inlet and an evaporator outlet, with the evaporator inlet coupled to the outlet of the first expansion device and the evaporator outlet coupled to the inlet of the suction accumulator.

Another aspect combinable with any of the previous aspects further includes a plurality of expansion valves having inlets coupled to a receiver outlet and having outlets coupled to the inlets of the first evaporator and the at least one additional evaporator, with the plurality of expansion valves causing adiabatic flash evaporation of refrigerant fluid received from the receiver.

Another aspect combinable with any of the previous aspects further includes a liquid separator having an inlet, a liquid-side outlet, and a vapor-side outlet.

Another aspect combinable with any of the previous aspects further includes an ejector having an ejector inlet, a secondary inlet, and an ejector outlet.

Another aspect combinable with any of the previous aspects further includes an expansion valve coupled between an outlet of the receiver and the inlet of the ejector to control a flow of the refrigerant fluid from the receiver to the ejector and to cause an adiabatic flash evaporation of a part of the refrigerant fluid received from the receiver.

In another aspect combinable with any of the previous aspects, an inlet of the at least one evaporator is coupled to the liquid-side outlet and an outlet of the at least one evaporator is coupled to the secondary inlet of the ejector.

In another aspect combinable with any of the previous aspects, an inlet of the evaporator is coupled to the ejector outlet and an outlet of the at least one evaporator is coupled to the liquid-side outlet of the liquid separator.

Another aspect combinable with any of the previous aspects further includes a pump having a pump inlet and a pump outlet.

Another aspect combinable with any of the previous aspects further includes an expansion valve coupled between an outlet of the receiver and the inlet of the liquid separator to control a flow of the refrigerant fluid from the receiver to the liquid separator and to cause an adiabatic flash evaporation of a part of the refrigerant fluid received from the receiver.

In another aspect combinable with any of the previous aspects, the pump inlet is coupled to the liquid-side outlet and the pump outlet is coupled to an inlet of the at least one evaporator.

In another aspect combinable with any of the previous aspects, an inlet of the at least one evaporator is coupled to the pump outlet and an outlet of the at least one evaporator is coupled to the inlet of the liquid separator.

In another aspect combinable with any of the previous aspects, the junction is a first junction, the system further including second and third junctions to couple the evaporator inlet to the pump outlet and the evaporator outlet to the inlet of the liquid separator.

Another aspect combinable with any of the previous aspects further includes an expansion valve having an inlet coupled to an outlet of the receiver and having an outlet coupled to an inlet of the at least one evaporator to control a flow of the refrigerant fluid from the receiver to the at least one evaporator and to cause an adiabatic flash evaporation of a part of the refrigerant fluid received from the receiver.

In another aspect combinable with any of the previous aspects, the hot vapor circuit further includes a solenoid valve having an inlet coupled to the compressor outlet and having an outlet; and a second expansion valve having an inlet coupled to the outlet of the solenoid valve, and having an outlet coupled to the inlet of the at least one evaporator to control a flow of the refrigerant fluid from compressor outlet to the evaporator and to cause an adiabatic flash evaporation of a part of the refrigerant fluid received from the compressor outlet.

In another aspect combinable with any of the previous aspects, the pump inlet is coupled to the liquid-side outlet and the pump outlet is coupled to the evaporator inlet.

In another aspect combinable with any of the previous aspects, the evaporator inlet is further coupled to the pump outlet and an outlet of the evaporator is coupled to the inlet of the liquid separator.

In another aspect combinable with any of the previous aspects, the junction is a first junction, the system further including second, third, and fourth junctions to couple the evaporator inlet to the pump outlet.

In another aspect combinable with any of the previous aspects, the expansion valve is configured to control a vapor quality of the refrigerant fluid at an outlet of the at least one evaporator.

In another aspect combinable with any of the previous aspects, the vapor quality is in a range of 0.5 up to 1.0.

In another aspect combinable with any of the previous aspects, the vapor quality is in a range of 0.6 up to 0.95.

In another aspect combinable with any of the previous aspects, the vapor quality is in a range of 0.8 up to 0.85.

In another aspect combinable with any of the previous aspects, the refrigerant fluid is ammonia.

In another example implementation, a thermal management method includes transporting refrigerant fluid through a refrigeration system having a refrigerant fluid path with a receiver and at least one evaporator that is in at least one of thermal conductive or convective contact with at least one heat load having a specified thermal inertia; and removing heat from the at least one heat load with the refrigerant fluid transported to the at least one evaporator.

An aspect combinable with the example implementation further includes transporting at least a portion of the refrigerant fluid through a hot vapor circuit to add heat to the heat load with the evaporator.

In another aspect combinable with any of the previous aspects, transporting the portion is a first mode of operation, and the method further includes extracting the heat from the heat load in contact with the at least one evaporator during a second mode of operation.

Another aspect combinable with any of the previous aspects further includes controlling the refrigerant fluid received from the receiver to the at least one evaporator, with a flow control device that is disposed the refrigerant fluid path.

Another aspect combinable with any of the previous aspects further includes separating a saturated vapor fraction from a liquid fraction of the refrigerant fluid received from the at least one evaporator.

Another aspect combinable with any of the previous aspects further includes compressing a saturated vapor received from the liquid separator into a superheated vapor; condensing the superheated vapor into a refrigerant liquid by removing heat from the superheated vapor in the second mode; and delivering the refrigerant liquid to the receiver.

Another aspect combinable with any of the previous aspects further includes regulating operation between the first and second modes by controlling operation of a solenoid valve in the hot vapor circuit.

In another aspect combinable with any of the previous aspects, the refrigerant is ammonia.

One or more of the above aspects or another of the disclosed aspects may include one or more of the following advantages.

The aspects enable cooling of high heat loads that are also highly temperature sensitive, while avoiding the size and weight constraints of conventional closed-cycle refrigeration systems. The thermal management systems (TMS) described herein are closed-circuit refrigeration systems that are deliberately undersized for the cooling duty. Instead, the disclosed closed-circuit refrigeration systems are sized according to the thermal inertia of the evaporator, and operates intermittently with sufficient time for cool down, and still extracts excess heat energy from large, high heat flux temperature sensitive components to accurately match temperature set point ranges for the components during the intermittent periods of operation.

At the same time, the disclosed thermal management systems require less power than a conventional closed-circuitry system sized for the required amount of refrigeration over the specified period(s) of operation. The conventional refrigeration systems use closed-circuit refrigerant flow paths, the systems and methods disclosed herein use modified closed-circuit refrigerant flow paths to handle the high heat loads, and to maintain a temperature of a load within ranges of the temperature set points for the components.

Directed energy systems that are mounted to mobile vehicles, such as trucks or that exist in space may be ideal candidates for cooling by the thermal management system presented, as such systems may include high heat loads, and temperature sensitive components that require precise cooling within a range of a temperature set point during operation over a specified time interval. The thermal management systems disclosed herein, while generally applicable to the cooling of a wide variety of heat loads, are particularly well suited for operation with such directed energy systems.

The disclosed TMS avoids the need for a relatively large and heavy refrigeration system, in comparison to the disclosed TMS, with a concomitant need for a large and heavy power system to sustain operation of the refrigeration system).

The details of one or more embodiments are set forth in the accompanying drawings and the description below. Other features and advantages will be apparent from the description, drawings, and claims.

DETAILED DESCRIPTION

Figure 1A:
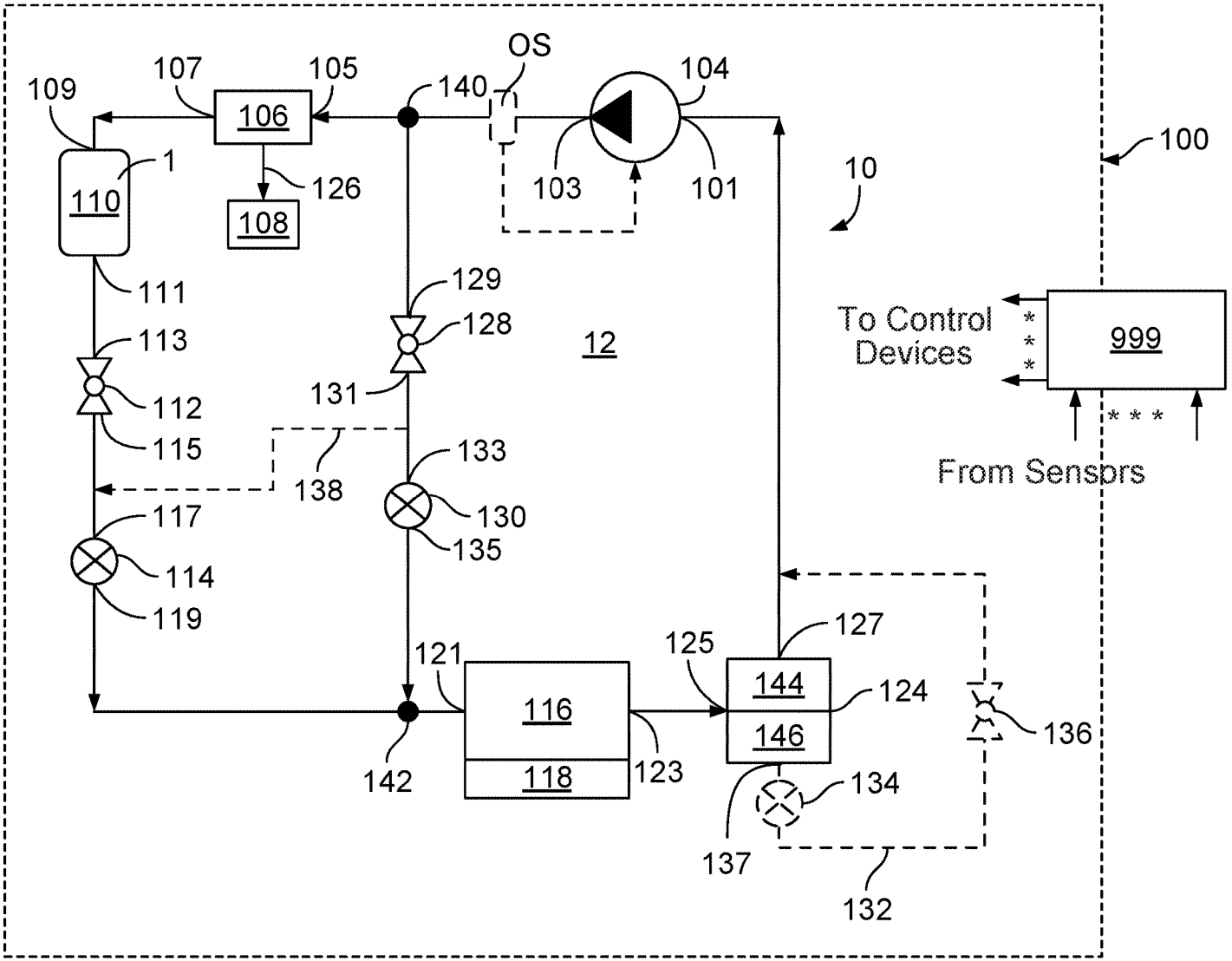
FIG. 1A is a schematic diagram of example implementations of a thermal management system that includes a hot vapor circuit in a closed-circuit refrigeration system according to the present disclosure.

Cooling of large heat loads, e.g., high heat loads that are also highly temperature sensitive, can present a number of challenges. On the one hand, such loads generate significant quantities of heat that is extracted during cooling. In conventional closed-cycle refrigeration systems, cooling high heat loads typically involves circulating refrigerant fluid at a relatively high mass flow rate. However, closed-cycle system components that are used for refrigerant fluid circulation—including large compressors to compress vapor at a low pressure to vapor at a high pressure and condensers to remove heat from the compressed vapor at the high pressure and convert to a liquid—are typically heavy and consume significant power. As a result, many closed-cycle systems are not well suited for deployment in mobile platforms—such as on small vehicles or in space—where size and weight constraints may make the use of large compressors and condensers impractical.

In some examples, a thermal management system (TMS) cools very high heat loads that operate over very short intervals of time. In some cases, the thermal inertia of the high heat loads is high, the allowed operation temperature range is relatively large, having a low-end of operating temperature limit and a high-end of operating temperature. The interval of time over which the heat load temperature rises from the low end of the operation temperature range to the high end of the operating temperature range, with no external cooling medium other than heat load dissipation into an ambient, is significant, but still less than the required performance period.

Some temperature sensitive loads such as electronic components and devices may require temperature regulation within a defined range of operating temperatures. A vapor cycle system (VCS), i.e., a closed-circuit refrigeration system (CCRS), modified as disclosed herein, may be used to maintain temperature within the operation temperature range within the required performance period.

Directed energy systems that are mounted to mobile vehicles, such as trucks, or that exist in space may present many of the foregoing operating challenges, as such systems may include high heat flux and temperature sensitive components that require precise cooling during operation for a required performance period. The thermal management systems disclosed herein, while generally applicable to the cooling of a wide variety of heat loads, are particularly well suited for operation with such directed energy systems.

In particular, the thermal management systems and methods disclosed herein include a number of features that reduce both overall size and weight relative to conventional closed-circuit refrigeration systems, and still extract excess heat energy from high heat flux temperature sensitive components to accurately match temperature set point ranges for the components.

At the same time, the disclosed thermal management systems that use the compressor would in general require less power than conventional closed-circuitry systems for a given amount of refrigeration over a specified period(s) of operation. The condenser rejecting heat would be smaller and lighter. The fans moving air cooling the condenser would be smaller, lighter, and consume less power. Whereas certain conventional refrigeration systems used closed-circuit refrigerant flow paths, the systems and methods disclosed herein use modified closed-circuit refrigerant flow paths to handle a variety of heat loads.

In some aspects, "refrigeration" as used in the present disclosure can mean a system (or multiple systems fluidly coupled) that operates to generate a purposeful change of a characteristic of a coolant (e.g., a refrigerant fluid) to effectuate or increase heat transfer between two mediums (one of which can be the coolant). The purposeful change of the characteristic can be, for example, a change in pressure (e.g., depressurization) of a pressurized coolant though an expansion valve. In some embodiments, the change in pressure can include a phase change of the coolant, such as a liquid-to-gas phase change (e.g., endothermic vaporization). In some embodiments, pressurization of the refrigerant can be performed by a powered (e.g., electrically or otherwise) component, such as (but not limited to) a compressor. In some embodiments, pressurization can be performed as part of the refrigeration cycle (e.g., a closed-cycle refrigeration process in which gaseous refrigerant is substantially or completely recycled and compressed into a liquid state) or prior to use (e.g., storing pre-compressed liquid refrigerant for later use in an open-cycle refrigeration process in which a reserve of liquid refrigerant is used but substantially not recycled). In some embodiments, the phase change can be driven by heating a liquid refrigerant with a very low boiling point (e.g., ammonia as used in an absorption-type refrigeration cycle).

Referring to FIG. 1A, a thermal management system (TMS) 100 includes a closed-circuit refrigeration system (CCRS) 10. TMS 100 provides closed-circuit refrigeration for one or more heat loads 118, e.g., high heat loads over short-time intervals. The CCRS 10 includes a receiver 110 that includes an inlet 109 and an outlet 111 and stores a refrigerant fluid 1. The outlet 111 is coupled to an inlet 113 of an optional solenoid valve 112 that also has an outlet 115. The outlet 115 of the optional solenoid valve 112 is coupled to an inlet 117 of a flow control device 114 (also referred to as expansion valve 114) having an outlet 119. The solenoid valve 112 can be used when the expansion valve 114 is used but is not able to completely stop refrigerant flow when the TMS 100 is in an OFF state.

Receiver 110, as shown, can include an optional pressure relief valve. To charge receiver 110, refrigerant fluid 1 is typically introduced into receiver 110 via the inlet 109, and this can be done, for example, at service locations. In case of emergency, if the fluid pressure within receiver 110 exceeds a pressure limit value, a pressure relief valve opens to allow a portion of the refrigerant fluid to escape through the valve to reduce the fluid pressure within receiver 110. Receiver 110 is typically implemented as an insulated vessel that stores refrigerant fluid 1 at relatively high pressure. Receiver 110 can also include insulation applied around the receiver to reduce thermal losses. In general, receiver 110 can have a variety of different shapes. In some embodiments, for example, the receiver 110 is cylindrical. Examples of other possible shapes include, but are not limited to, rectangular prismatic, cubic, and conical. In certain embodiments, receiver 110 can be oriented such that outlet 111 is positioned at the bottom of the receiver. In this manner, the liquid portion of the refrigerant fluid 1 within receiver 110 is discharged first through outlet 111, prior to discharge of refrigerant vapor. In certain embodiments, the refrigerant fluid 1 can be an ammonia-based mixture that includes ammonia and one or more other substances. For example, mixtures can include one or more additives that facilitate ammonia absorption or ammonia burning.

The CCRS 10 also includes an evaporator 116 (with detailed configurations shown in FIGS. 7A-7D) having an inlet 121 and an outlet 123. The inlet 121 of the evaporator 116 is coupled to an outlet of a junction 142 and the outlet 123 of the evaporator 116 is coupled to an inlet 125 of a liquid separator 124. The liquid separator 124 also has a vapor-side outlet 127. The evaporator 116 is in thermal conductive and/or convective contact or in proximity to a high heat load 118.

Evaporator 116 can be implemented in a variety of ways. In general, evaporator 116 functions as a heat exchanger, providing thermal contact (conductive, convective, or both) between the refrigerant fluid 1 and high heat load 118. Typically, evaporator 116 includes one or more flow channels extending internally between inlet 121 and outlet 123 of the evaporator 116, allowing refrigerant fluid 1 to flow through the evaporator 116 and absorb heat from heat load(s) 118. A variety of different evaporators can be used in TMS 100. In general, any cold plate may function as the evaporator 116 of the closed-circuit refrigeration systems disclosed herein. Evaporator 116 can accommodate any refrigerant fluid channels (including mini/micro-channel tubes), blocks of printed circuit heat exchanging structures, or more generally, any heat exchanging structures that are used to transport single-phase or two-phase fluids. The evaporator 116 and/or components thereof, such as fluid transport channels, can be attached to the heat load(s) 118 mechanically, or can be welded, brazed, or bonded to the heat load in any manner. In some embodiments, evaporator 116 (or certain components thereof) can be fabricated as part of heat load(s) 118 or otherwise integrated into one or more of the heat load(s) 118, in which high heat load 118 can have one or more integrated refrigerant fluid channels. The portion of high heat load 118 with the refrigerant fluid channel(s) effectively functions as the evaporator 116 for the CCRS 10.

Figure 7A:
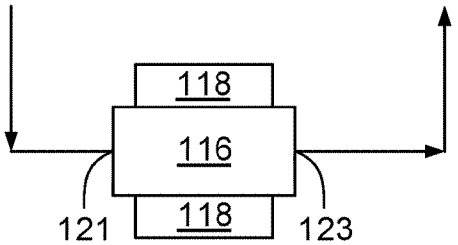
FIGS. 7A-7D are schematic diagrams showing alternative configurations for arrangements of evaporators on the closed-circuit refrigeration system according to the present disclosure.

In this example, and with reference to FIG. 7A as well, the evaporator 116 can act with thermal contact (e.g., conductive and/or convective) to cool a large heat load, such as the heat load 118 that acts or is applied in relatively short time periods. More specifically, heat load 118 can have a relatively high thermal inertia, but the allowed temperature range in which the heat load 118 can operate (e.g., for normal or proper operation) is also large. In some aspects, a time period in which the temperature of heat load 118 rises from a low end of the operation temperature band to its high end with no cooling, is significant, but still less than a required performance period. Generally, the thermal inertia of the heat load 118, or more specifically, the combination of the evaporator 116 in thermal contact with the heat load 118, is the rate at which a temperature of this package (evaporator plus heat load) reaches that of its surrounding environment. In other words, the thermal inertia of the package is its capacity to store heat and to delay its transmission. The package that has a high thermal inertia, therefore, will take a longer time to reach the temperature of the surrounding environment, absent additional heating or cooling.

The interval of time over which the temperature of heat load 118 rises from the low end of the operation temperature range to the high end of the operating temperature range, with no external cooling medium other than heat load dissipation into an ambient, is significant, but still less than a required performance period. In example aspects according to the present disclosure (which can include open- or closed-circuit refrigeration systems or a combination thereof), the evaporator 116 (and other components of the systems such as compressors, condensers, receivers, valves, or otherwise) can be sized according to the thermal inertia of the package (evaporator 116 and heat load 118), and operate intermittently with sufficient time for cool down, and still extracts excess heat energy from the heat load 118 (which can be a high temperature or high heat flux load as well).

In this example, liquid separator 124 includes inlet 125, vapor side outlet 127, and liquid side outlet 137, as well as vapor section 144 and liquid section 146. Other examples of TMS according to the present disclosure may have a suction accumulator 124 (with inlet 125 and vapor side outlet 127 but no liquid side outlet 137) in place of a liquid separator. As a liquid separator 124, this component can be a coalescing liquid separator or a flash drum, for example. Other conventional details such as membranes, coalescing filters, or meshes, etc. are not shown.

The CCRS 10 also includes a compressor 104 having an inlet 101 coupled to the vapor-side outlet 127 of the suction accumulator 124, and also an outlet 103 that is coupled to an inlet 105 of a condenser 106. The condenser 106 has an outlet 107 that is coupled to the receiver inlet 109. A fan 108 (or pump 108) is positioned to circulate a cooling airflow 126 (or cooling water flow 126) across the condenser 106 to condense the refrigerant fluid 1 from the compressor 104. The aforementioned components are coupled via conduit (not referenced).

As used herein the compressor 104 is, in general, a device that increases the pressure of a gas by reducing the gas' volume. Usually, the term compressor refers to devices operating at and above ambient pressure, (some refrigerant compressors may operate inducing refrigerant at pressures below ambient pressure, e.g., desalination vapor compression systems employ compressors with suction and discharge pressures below ambient pressure).

In general, the solenoid valves 112-128 include a solenoid that uses an electric current to generate a magnetic field to control a mechanism that regulates an opening in a valve to control fluid flow. In some aspects, such valves 112 and 128 (and expansion valve 114 etc.) can act as flow control devices configurable to stop refrigerant flow as an on/off valve.

Expansion valve 114 functions as a flow control device and in particular as a refrigerant expansion valve device. In general, expansion valve 114 can be implemented as any one or more of a variety of different mechanical and/or electronic devices. For example, in some embodiments, expansion valve 114 can be implemented as a fixed orifice, a capillary tube, and/or a mechanical or electronic expansion valve. In general, fixed orifices and capillary tubes are passive flow restriction elements which do not actively regulate refrigerant fluid flow.

Mechanical expansion valves (usually called thermostatic or thermal expansion valves) are typically flow control devices that enthalpically expand a refrigerant fluid from a first pressure to an evaporating pressure, controlling the superheat at the evaporator exit. Mechanical expansion valves generally include an orifice, a moving seat that changes the cross-sectional area of the orifice and the refrigerant fluid volume and mass flow rates, a diaphragm moving the seat, and a bulb at the evaporator exit. The bulb is charged with a fluid and it hermetically fluidly communicates with a chamber above the diaphragm. The bulb senses the refrigerant fluid temperature at the evaporator exit (or another location) and the pressure of the fluid inside the bulb transfers the pressure in the bulb through the chamber to the diaphragm and moves the diaphragm and the seat to close or to open the orifice.

Typical electrically controlled expansion valves include an orifice, a moving seat, a motor or actuator that changes the position of the seat with respect to the orifice, a controller, and pressure and temperature sensors at the evaporator exit.

Examples of suitable commercially available expansion valves that can function as expansion valve 114 include, but are not limited to, thermostatic expansion valves available from the Sporlan Division of Parker Hannifin Corporation (Washington, Mo.) and from Danfoss (Syddanmark, Denmark).

The control system 999 calculates the superheat for the expanded refrigerant fluid based on pressure and temperature measurements at the evaporator exit. If the superheat is above a set-point value, the seat moves to increase the cross-sectional area and the refrigerant fluid volume and mass flow rates to match the superheat set-point value. If the superheat is below the set-point value the seat moves to decrease the cross-sectional area and the refrigerant fluid flow rates. The control system 999 may be configured to control vapor quality at the evaporator exit as disclosed below.

The CCRS 10 can also optionally include a hot vapor circuit 12 including a solenoid valve 128 having an inlet 129 and an outlet 131, an expansion valve 130 having an inlet 133 and an outlet 135, a junction 140, and the junction 142. The solenoid valve inlet 128 and the expansion valve 130 are coupled to a first outlet of the junction 140 and an inlet of the junction 142. Junction 140 has an inlet coupled to the compressor outlet 103 and a second outlet coupled to the inlet 105 of the condenser 106. The junction 142 has a second inlet coupled to the outlet 131 of the solenoid valve 128 (or expansion valve 130 if used) and has the outlet coupled to the inlet 121 of the evaporator 116. The solenoid valve 128, expansion valve 130, and junctions 140, 142 couple the hot vapor circuit 12 to the evaporator inlet 121 and outlet 119 of expansion valve 114.

In this example implementation, the TMS 100 can optionally include bypass 138 that fluidly couples the outlet 131 of solenoid valve 128 to the inlet 117 of the expansion valve 114 (and thus the inlet 121 of the evaporator through junction 142 while eliminating optional expansion valve 130). As explained in more detail herein, in this optional configuration of the CCRS 10, hot vapor is diverted to the expansion valve 114 that enthalpically expands the high pressure sub-cooled liquid refrigerant and the hot vapor into liquid-vapor mixture at a low pressure and temperature.

As further shown in FIG. 1A, TMS 100 can also optionally include an oil circuit that includes conduit 132 fluidly coupled to liquid outlet 137 of the liquid separator 124. In configurations that do not include the conduit 132 and oil circuit, the liquid separator 124 can be implemented as a suction accumulator 124 with inlet 125 and vapor outlet 127 (but no liquid outlet 137). Oil is used for lubrication of the compressor 104 and the oil travels with the refrigerant fluid 1 in the CCRS 10. The oil is removed from the refrigerant fluid 1 at the liquid-side outlet 137 of the liquid separator 124, and is recirculated back to the compressor inlet 101, via a metering orifice 134 and a solenoid valve 136 (both optional as with the oil circuit). The oil also can be removed from the inlet 125 of the suction accumulator 124 or elsewhere within the CCRS 10. In addition, the CCRS 10 may include an oil separator (OS). The oil separator (OS) is disposed in an oil return path (denoted by dashed line).

In an example implementation of the TMS 100 (e.g., that does not include optional bypass 138 or the aforementioned oil circuit), the CCRS 10 can operates in the following modes: Standby (thermolyze the evaporator 116 and heat loads 118 via heating or cooling); Cooling mode (heat load 118 on); Cooling mode (heat load 118 off); and Optional pump-down cycle.

In an example Standby operation, the CCRS 10 maintains the heat load 118 at a temperature corresponding to the low end of the allowed operating temperature range. If ambient temperature is higher than the low end of the allowed operating temperature range, the CCRS 10 cools the evaporator 116 and attached heat load(s) 118 bringing its temperature down to the low end of the allowed operating temperature range. When the ambient temperature (e.g., of airflow 126) is lower than the low end of the allowed operating temperature range and the hot vapor circuit 12 is available, the hot vapor circuit 12 provides hot vapor that heats the evaporator 116 and attached heat loads 118, bringing them up to the low end of the allowed operating temperature range.

In an example thermolyzing-cooling operation, if ambient temperature is higher than the low end of the allowed operating temperature range for the high heat load 118, the CCRS 10 operates in a cooling mode. In the cooling mode, the solenoid valve 112 is open and the solenoid valve 128 is closed. When the ambient temperature is higher than the low end of the allowed temperature range for the high heat load 118, the TMS 100 is configured to have the CCRS 10 provide refrigeration to the high heat load 118. In this instance, a control system 999 produces signals to cause the solenoid valve 112 to open and solenoid valve 128 to close.

Circulating refrigerant enters the compressor 104 as a saturated or superheated vapor and is compressed to a higher pressure at a higher temperature (a superheated vapor). This superheated vapor is at a temperature and pressure at which it can be condensed in the condenser 106 by either cooling water 126 or cooling air 126 flowing across a coil or tubes in the condenser 106. At the condenser 106, the circulating refrigerant loses heat and thus removes heat from the system, which removed heat is carried away by either the water or air (whichever may be the case) flowing over the coil or tubes, providing a condensed, sub-cooled liquid refrigerant.

The condensed, sub-cooled liquid refrigerant is routed into the receiver 110, exits the receiver 110, and enters the solenoid valve 112 and the expansion valve 114. The condensed, sub-cooled liquid refrigerant is enthalpically expanded in the expansion valve 114 and turns into a two-phase refrigerant mixture of a liquid-vapor at a low pressure and temperature. The temperature of the two-phase refrigerant mixture (evaporating temperature) is lower than the temperature of the high heat load 118. The two-phase refrigerant mixture is routed through the evaporator 116.

The heat from the high heat load 118, in thermal conductive and/or convective contact with or proximate to the evaporator 116, partially or completely evaporates the liquid portion of the two-phase refrigerant mixture, according to desired vapor quality, and may superheat the two-phase refrigerant mixture. The refrigerant leaves the evaporator 116 and enters the suction accumulator 124, as a saturated or superheated vapor. The saturated or superheated vapor exits the suction accumulator 124 and enters the compressor 104 to complete the refrigeration cycle. The evaporator 116 is where the circulating refrigerant absorbs and removes heat from the high heat load 118, which heat is subsequently rejected in the condenser 106 and transferred to an ambient by water or air used in the condenser 106.

In an example thermolyzing-heating operation, if ambient temperature is lower than the low end of the allowed operating temperature band, the CCRS 10 operates in a heating mode. In the heating mode, the solenoid valve 112 is closed and the solenoid valve 128 is open. When the ambient temperature is lower than the low end of the allowed temperature range for the high heat load 118, the TMS 100 is configured to have the CCRS 10 provide heat to the high heat load 118. In this instance, the control system 999 produces signals to cause the solenoid valve 112 to be closed and solenoid valve 128 to be open.

Circulating refrigerant enters the compressor 104 as a saturated or superheated vapor and is compressed to a higher pressure at a higher temperature (a superheated vapor). A first portion of the superheated vapor is at a temperature and pressure at which it can be condensed in the condenser 106 by either cooling water 126 or cooling air 126 flowing across a coil or tubes in the condenser 106. At the condenser 106, the first portion of the circulating refrigerant loses heat and thus removes heat from the CCRS 10, which removed heat is carried away by either the water or air (whichever may be the case) flowing over the coil or tubes, providing a condensed liquid refrigerant. The condensed and sub-cooled first portion is now in a liquid refrigerant phase and is routed into the receiver 110, but does not exit the receiver 110, while the solenoid valve 112 is closed.

However, with the solenoid valve 128 open, a second portion, the superheated vapor, the hot vapor portion is expanded at a constant enthalpy in the expansion valve 130 and enters the evaporator 116 where it heats the high heat load 118. The gas is cooled in the expansion valve 130 but remains hot. The high heat load 118, in thermal conductive and/or convective contact with or proximate to the evaporator 116, is heated by the second portion of the superheated vapor. The refrigerant leaves the evaporator 116 and enters the suction accumulator 124. The superheated (or in ideal case saturated) vapor passes through the suction accumulator 124 and enters the compressor 104. In this mode, the evaporator 116 is where the circulating refrigerant adds heat to the high heat load 118. To complete the refrigeration cycle, the refrigerant vapor from the evaporator 116 exits the suction accumulator 124 at the vapor-side outlet 127 entering the compressor 104.

In some cases to avoid entering too hot vapor into the compressor 104, the solenoid valve 112 may open and the expansion valve 114 will cool the hot vapor to maintain the temperature of superheated vapor within the allowed range. Cold ambient temperature may cause significant reduction of the condensation temperature and discharge pressure. In this case a head pressure control is engaged to prevent discharge pressure reduction below the limit. In the previous inventions we described different methods.

In an example cooling mode-heat load ON operation, according to the present disclosure, the evaporator 116 and the high heat load 118 have natural high thermal inertia, which allows under the highest load, the temperature rise from the low end to the high end of the allowed temperature range in a certain, relatively short, period. The CCRS 10 is configured to enable the temperature rise in the given period which is longer than the thermal inertia can provide. To do that the CCRS 10 may be sized for a cooling capacity which is smaller than the power input of the heat load 118 and have a smaller dimensions and weight.

After the thermolyzing in cooling mode, in standby mode, the evaporator 116 and the heat load 118 are at the low end of the end of the allowed temperature range. When the heat load 118 is ON, the CCRS 10 is ON. When the evaporator 116 and the heat load 118 hit at the high end of the allowed temperature range, the heat load 118 is switched to an OFF state.

In an example cooling mode-heat load OFF operation, the CCRS 10 continues to operate until the evaporator 116 and the heat load 118 hit at the low end of the allowed temperature range. In order to prevent quick reduction of the suction pressure during pump-down cycle, the solenoid valve 128 may be opened to provide hot vapor bypass suction pressure control.

In an example pump-down operation, a pump-down cycle may be used to return liquid refrigerant that accumulates in the suction accumulator 124 back to the receiver 110. In order to prevent quick reduction of the suction pressure during pump-down cycle, the solenoid valve 128 may be opened to provide hot vapor bypass suction pressure control. If the expansion valve 114 is configured to operate at a superheat, then the suction accumulator 124 and the pump-down cycle may not be needed.

If bypass 138 is implemented (and expansion valve 130 is eliminated), then an alternative hot vapor circuit can be used. In such a modified configuration, the CCRS 10 can also operate in the following modes: Standby (thermolyze the evaporator 116 and heat loads 118 via heating or cooling); Cooling mode (heat load 118 on); Cooling mode (heat load 118 off); and Optional pump-down cycle. In the Standby operation, the CCRS 10 maintains the high heat load 118 at a temperature corresponding to the low end of the allowed operating temperature range.

In a thermolyzing-cooling operation, the CCRS 10 operates as previously described. However, in a thermolyzing-heating operation, the CCRS 10 does not utilize the expansion valve 130, which has been eliminated. Thus, with the solenoid valve 128 open, a second portion of the hot superheated vapor is diverted to the inlet 117 of the expansion valve 114. The superheated hot vapor enters the expansion valve 114. At the outlet 119 of the expansion valve 114, the expanded refrigerant at the elevated temperature is coupled to the inlet 121 of the evaporator 116. The high heat load 118, in thermal conductive and/or convective contact with or proximate to the evaporator 116, is heated by the expanded refrigerant at the elevated temperature, i.e., provided by the second portion of the superheated vapor. The refrigerant leaves the evaporator 116 and enters the suction accumulator 26. The saturated or superheated vapor exits the suction accumulator 124 and enters the compressor 104. In this mode, the evaporator 116 is where the circulating refrigerant adds heat to the high heat load 118. To complete the refrigeration cycle, the refrigerant vapor from the evaporator 116 exits the suction accumulator 124 at the vapor-side outlet 127 and enters the compressor 104. In the cooling mode (heat load ON or heat load OFF) operation and optional pump down operation, the CCRS 10 with bypass 138 operates as previously described.

As shown in FIG. 1A, the TMS 100, as all disclosed embodiments, also includes the control system (or controller) 999 (see FIG. 8 for an exemplary embodiment) that produces control signals (based on sensed thermodynamic properties) to control operation of one or more of the various devices, e.g., optional solenoid control valve 112, expansion valve 114, etc., as needed, as well as to control operation of a motor of the compressor 104, a fan 108, or other components in other example implementations of a TMS. Control system 999 may receive signals, process received signals and send signals (as appropriate) from/to the sensors and control devices to operate the TMS 100.

The term "control system," as used herein, can refer to an overall system that provides control signals and receives feedback data from unit controllers, such as unit controllers (e.g., programmable logic controllers, motor controllers, variable frequency drives, actuators). In some aspects, the control system includes the overall system and the unit controllers. In some aspects, a control system simply refers to as a single unit controller or a network of two or more individual unit controllers that communicate directly with each other (rather than with an overall system.

The process streams (e.g., refrigerant flows, ambient airflows, other heat exchange fluid flows) in a TMS according to the present disclosure, as well as process streams within any downstream processes with which the TMS is fluidly coupled, can be flowed using one or more flow control systems (e.g., that include the control system 999) implemented throughout the system. A flow control system can include one or more flow pumps, fans, blowers, or solids conveyors to move the process streams, one or more flow pipes through which the process streams are flowed and one or more valves to regulate the flow of streams through the pipes, whether shown in the exemplary figures or not. Each of the configurations described herein can include at least one variable frequency drive (VFD) coupled to a respective pump or fan that is capable of controlling at least one fluid flow rate. In some implementations, liquid flow rates are controlled by at least one flow control valve.

In some embodiments, a flow control system can be operated manually. For example, an operator can set a flow rate for each pump or transfer device and set valve open or close positions to regulate the flow of the process streams through the pipes in the flow control system. Once the operator has set the flow rates and the valve open or close positions for all flow control systems distributed across the system, the flow control system can flow the streams under constant flow conditions, for example, constant volumetric rate or other flow conditions. To change the flow conditions, the operator can manually operate the flow control system, for example, by changing the pump flow rate or the valve open or close position.

In some embodiments, a flow control system can be operated automatically. For example, the flow control system can be connected to a computer or control system (e.g., control system 999) to operate the flow control system. The control system can include a computer-readable medium storing instructions (such as flow control instructions and other instructions) executable by one or more processors to perform operations (such as flow control operations). An operator can set the flow rates and the valve open or close positions for all flow control systems distributed across the facility using the control system. In such embodiments, the operator can manually change the flow conditions by providing inputs through the control system. Also, in such embodiments, the control system can automatically (that is, without manual intervention) control one or more of the flow control systems, for example, using feedback systems connected to the control system. For example, a sensor (such as a pressure sensor, temperature sensor or other sensor) can be connected to a pipe through which a fluid flows. The sensor can monitor and provide a flow condition (such as a pressure, temperature, or other flow condition) of the process stream to the control system. In response to the flow condition exceeding a threshold (such as a threshold pressure value, a threshold temperature value, or other threshold value), the control system can automatically perform operations. For example, if the pressure or temperature in the pipe exceeds the threshold pressure value or the threshold temperature value, respectively, the control system can provide a signal to the pump to decrease a flow rate, a signal to open a valve to relieve the pressure, a signal to shut down process stream flow, or other signals.

Figure 1B:
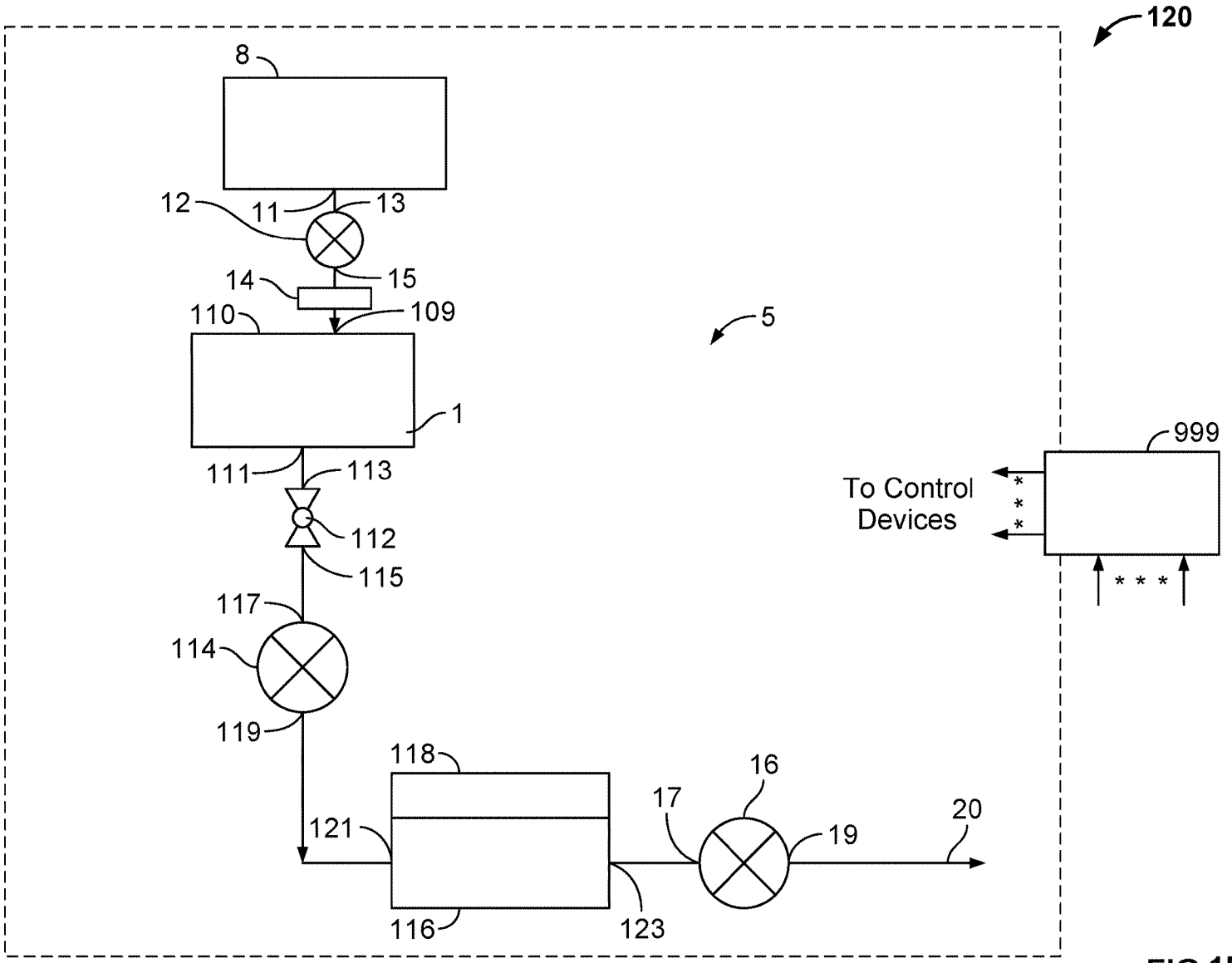
FIG. 1B is a schematic diagram of an example of a thermal management system (TMS) that includes an open-circuit refrigeration system (OCRS) according to the present disclosure.

Referring now to FIG. 1B, a thermal management system (TMS) 120 includes an open circuit refrigeration system (OCRS) 5 that utilizes one or more evaporators 116 to cool one or more heat loads 118. The OCRS 5 includes receiver 110 having receiver inlet 109 and receiver outlet 111 and storing refrigerant fluid 1, the optional solenoid valve 112 having inlet 113 and outlet 115, the flow control device 114 (e.g., the expansion valve 114), the evaporator 116 having inlet 121 and outlet 123, and a solenoid valve 16 having an inlet 17 and an outlet 19. The aforementioned components of OCRS 5 are interconnected by one or more conduit sections to form an open circuit refrigerant fluid path. An optional flow control device 12 having inlet 13 and outlet 15 and optional check valve 14 are positioned along the gas flow path between the optional gas receiver 8 and the receiver 110.

In this example, one or more heat loads 118 can be considered high heat loads (e.g., with a high thermal inertia in combination with the evaporator 116) that are in thermal conductive and/or convective contact or in proximity with the evaporator 116. OCRS 5 optionally includes gas receiver 8 with the outlet 11 fluidly coupled to the inlet 109 of the receiver 110 via conduit, such that a gas flow path extends between the gas receiver 8 and the receiver 110 (that stores the refrigerant fluid 1). The optional flow control device 12 having inlet 13 and outlet 15, as well as the optional check valve 14 are positioned along the gas flow path between the optional gas receiver 8 and the receiver 110.

During operation of OCRS 5, cooling can be initiated by a variety of different mechanisms. In some embodiments, for example, OCRS 5 includes a temperature sensor attached to heat load 22 (as will be discussed subsequently) or to certain of heat loads 118. When the temperature of heat load 22 exceeds a certain temperature set point (i.e., threshold value), a control system 999 (described in additional detail below) connected to the temperature sensor can initiate cooling of heat load 22. Alternatively, in certain embodiments, OCRS 5 operates essentially continuously—provided that the pressure within receiver 110 is sufficient—to cool heat loads 118. As soon as receiver 110 is charged with refrigerant fluid, refrigerant fluid is ready to be directed into evaporator 116 to cool heat loads 118. In general, cooling is initiated when a user of the system or the heat load issues a cooling demand.

The TMS 120 can also include the control system (or controller) 999 that produces control signals (based on sensed thermodynamic properties) to control operation of one or more of the various devices, e.g., optional solenoid control valve 112, expansion valve 114, etc., in other example implementations of a TMS. Control system 999 may receive signals, process received signals and send signals (as appropriate) from/to the sensors and control devices to operate the TMS 120.

Figure 2:
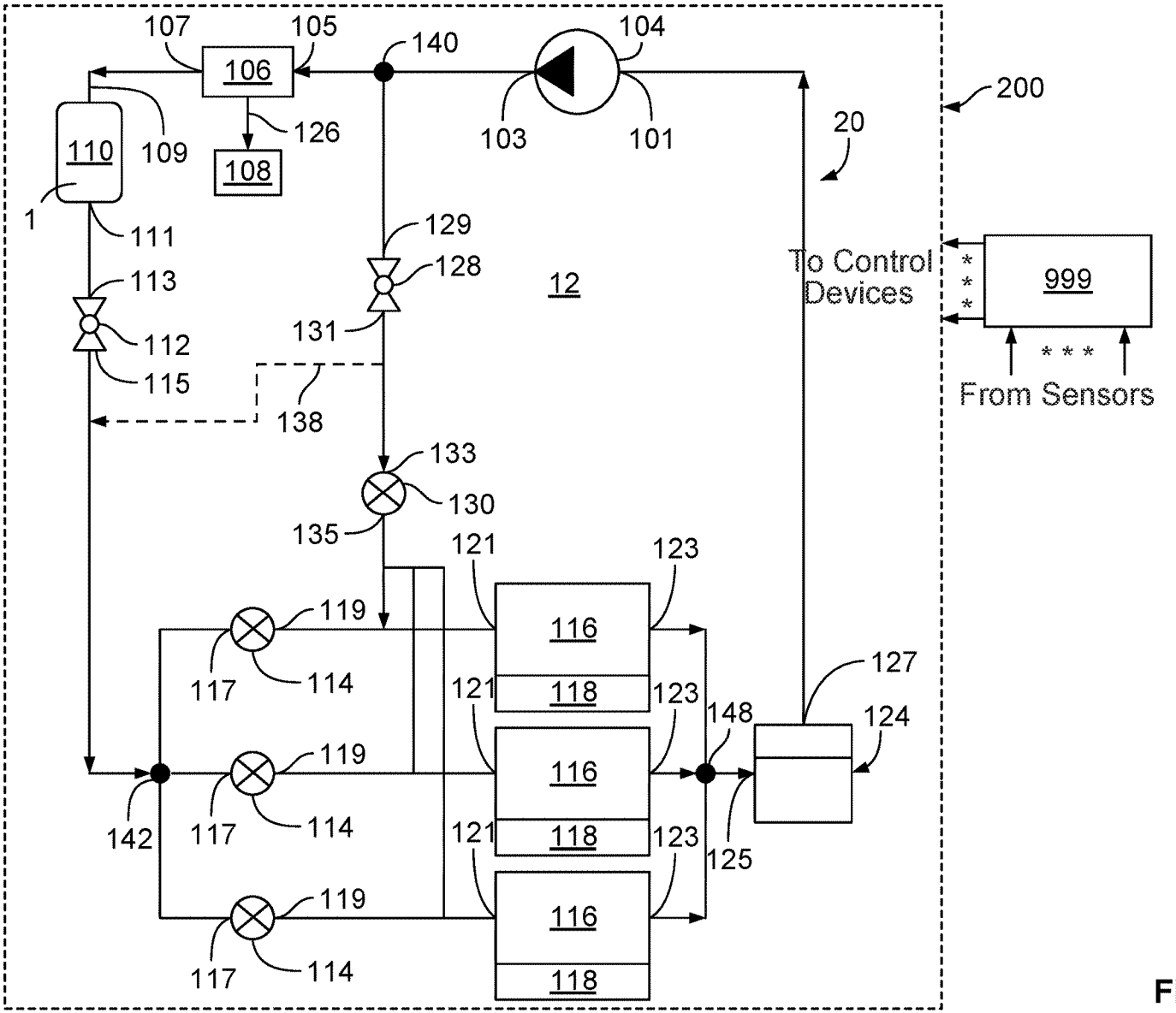
FIGS. 2-6 are schematic diagrams of example implementations of a thermal management system that includes a hot vapor circuit in a closed-circuit refrigeration system according to the present disclosure.

Referring to FIG. 2, a thermal management system (TMS) 200 includes a closed-circuit refrigeration system (CCRS) 20. TMS 200 provides closed-circuit refrigeration for one or more heat loads 118, e.g., high heat loads over short-time intervals, with multiple evaporators 116 in a parallel arrangement. Components shown in the TMS 200 that are also included in TMS 100 generally have the same structure and function as described with reference to FIG. 1A. In some aspects, although not shown, the oil circuit from FIG. 1A can be implemented in FIG. 2 as well (with a liquid separator 124 instead of suction accumulator).

As shown in FIG. 2, expansion valve 130 is fluidly coupled (at outlet 135) to inlets 121 of multiple (three shown, but two or more contemplated by the present disclosure) evaporators 116 (located downstream of the connection of outlet 135). As such, the outlet 135 is fluidly coupled to outlets 119 of multiple (three shown, but two or more contemplated by the present disclosure) expansion valves 114 (located upstream of the connection of outlet 135). In some aspects, TMS 200 can include a 1:1 ratio of expansion valves 114 to evaporators 116 (e.g., five evaporators 116 will have a corresponding one of five expansion valves 114). In some aspects, the CCRS 20 may be configured to have one expansion valve 114 for multiple evaporators 116 (rather than a 1:1 ratio) and use a conventional refrigerant distributor downstream of the single expansion valve 114 to the multiple evaporators 116. Each of the evaporators 116 may also have an individual suction accumulator 124 (rather than the single, manifolded suction accumulator 124 connected to outlets 123 by junction 148).

As shown in FIG. 2, TMS 200 can also include optional bypass 138—in such a modified configuration, TMS 200 would not include expansion valve 130. Thus, in such a modified configuration, the outlet 131 of solenoid valve 128 would be fluidly coupled to inlets 117 of expansion valves 114 through junction 142.

Without optional bypass 138, the CCRS 20 can also operate in the following modes: Standby (thermolyze the evaporator 116 and heat loads 118 via heating or cooling); Cooling mode (heat load 118 on); Cooling mode (heat load 118 off); and Optional pump-down cycle, similar to that discussed in FIG. 1A (without optional bypass 138), except that now three (or more) evaporators 116 are provided, each of which could be independently controlled.

With optional bypass 138 (and without expansion valve 130), the CCRS 20 can also operate in the following modes: Standby (thermolyze the evaporator 116 and heat loads 118 via heating or cooling); Cooling mode (heat load 118 on); Cooling mode (heat load 118 off); and Optional pump-down cycle. In this optional configuration, operation of CCRS 20 is similar to that discussed in FIG. 1A (with optional bypass 138), except that now three (or more) evaporators 116 are provided, each of which could be independently controlled.

Figure 3:
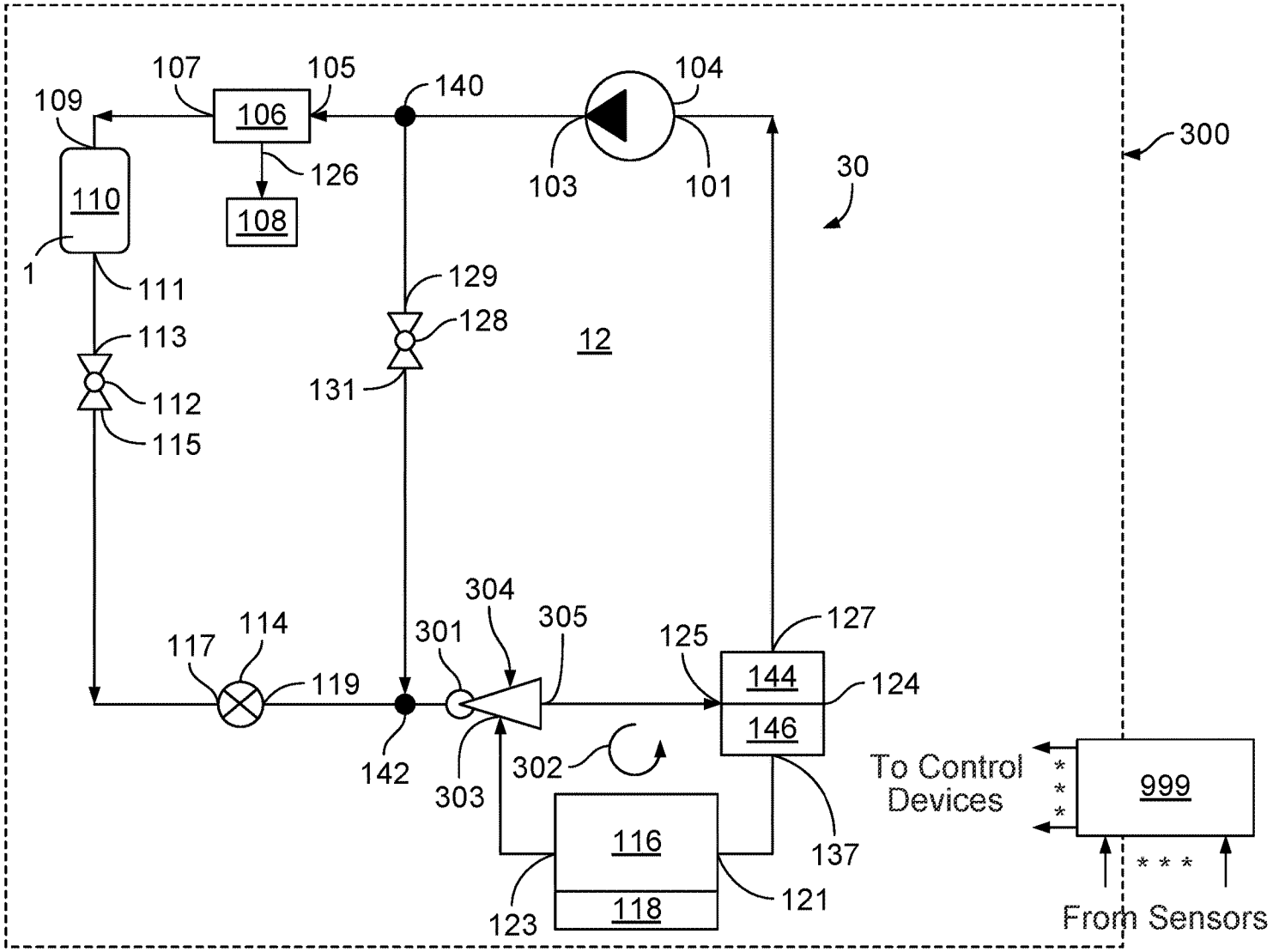

Referring to FIG. 3, a thermal management system (TMS) 300 includes a closed-circuit refrigeration system (CCRS) 30. TMS 200 provides closed-circuit refrigeration for one or more heat loads 118, e.g., high heat loads over short-time intervals, with an ejector assist circuit 302. Thus, in FIG. 3, an ejector 304 is used with a liquid separator 124 (in place of a suction accumulator).

Components shown in the TMS 300 that are also included in TMS 100 and/or TMS 200 generally have the same structure and function as described with reference to FIG. 1A and/or FIG. 2. In some aspects, although not shown, the oil circuit from FIG. 1A can be implemented in FIG. 3 as well.

The ejector assist circuit 302 includes the ejector 304, one or more evaporators 116, and the liquid separator 124. The ejector 304 includes a primary (motive) inlet 301, a secondary (suction) inlet 303, and an outlet 305. The optional solenoid valve 112 feeds refrigerant liquid from the receiver outlet 115 into the inlet 117 of the expansion valve 114. The outlet 119 of the expansion valve 114 is coupled to three-port junction 142 that has two inlets. One inlet is coupled to the outlet 119 of the expansion valve 114 and the other inlet is coupled to the outlet 131 of the solenoid valve 128. The outlet of the junction 142 is coupled to the primary inlet 301 of the ejector 304, feeding the expanded refrigerant into the ejector 304. The outlet 305 of the ejector 304 is coupled to the inlet 125 of the liquid separator 124. The liquid separator 124 also includes a vapor-side outlet 127 and a liquid-side outlet 137.

In this example configuration, the evaporator 116 has the outlet 123 fluidly coupled to the secondary inlet 303 (low-pressure inlet) of the ejector 304 and the evaporator 116 has the inlet 121 fluidly coupled to the liquid-side outlet 137 of the liquid separator 124. In this configuration, the ejector 304 acts as a "pump," to "pump" a secondary fluid flow, e.g., liquid/vapor from at the outlet of the evaporator 116 using energy of a primary refrigerant flow at the primary inlet 301 of the ejector, e.g., originating from the refrigerant flow from the receiver 110.

In a modified configuration of the ejector assist circuit 302, the evaporator 116 has the outlet 123 fluidly coupled to the inlet 125 of the liquid separator, and the inlet 121 fluidly coupled to the outlet 305 of the ejector 304. The liquid outlet 137 of the liquid separator 124 would be fluidly coupled to secondary inlet 303 of the ejector 304. In this configuration, the ejector 304 still acts as a "pump," to "pump" a secondary fluid flow, e.g., refrigerant liquid from liquid outlet 137 using energy of a primary refrigerant flow at the primary inlet 301 of the ejector, e.g., originating from the refrigerant flow from the receiver 110.

In a further modified configuration, dual evaporators 116 can be used in the ejector assist circuit 302. For example, a first evaporator 116 has outlet 123 fluidly coupled to the secondary inlet 303 (low-pressure inlet) of the ejector 304, and the first evaporator 116 has the inlet 121 fluidly coupled to the liquid-side outlet 137 of the liquid separator 124. A second evaporator 116 has the outlet 123 fluidly coupled to the inlet 125 of the liquid separator 124, and the second evaporator 116 has the inlet 121 fluidly coupled to the outlet 305 of the ejector 304.

Ejector 304, in this example, includes (as noted) a high-pressure motive nozzle or primary inlet 301, a suction or secondary inlet 303, a secondary nozzle that feeds a suction chamber, a mixing chamber for the primary flow of refrigerant and secondary flow of refrigerant to mix, and a diffuser. In example aspects, the ejector 304 is passively controlled by built-in flow control. Also, the CCRS 30 may employ the solenoid valve 128 and expansion valve 114 upstream of the primary inlet 301 to the ejector 304. Liquid refrigerant from the receiver 110 is the primary flow. In the motive nozzle 301, potential energy of the primary flow is converted into kinetic energy reducing the potential energy (the established static pressure) of the primary flow. The secondary flow from the outlet of the evaporator 116 has a pressure that is higher than the established static pressure in the suction chamber, and thus the secondary flow is entrained through the suction inlet 303 and the secondary nozzle(s) internal to the ejector 304. The two streams (primary flow and secondary flow) mix together in the mixing chamber. In the diffuser section, the kinetic energy of the mixed streams is converted into potential energy elevating the pressure of the mixed flow liquid/vapor refrigerant that leaves the ejector 304 and is fed to the inlet 125 of the liquid separator 124. In the context of closed-circuit refrigeration systems, the use of the ejector 304 allows for recirculation of liquid refrigerant captured by the liquid separator 124 to increase the efficiency of the CCRS 30. That is, by allowing for some recirculation of refrigerant, but without the need for a compressor or a condenser, this recirculation reduces the required amount of refrigerant needed for a given amount of cooling of high heat loads over the given period of operation of the CCRS 30.

The CCRS 30 also includes the hot vapor circuit 12 including the solenoid valve 128 that is coupled between the compressor outlet 103 and condenser inlet 105, via junction 140, and between the expansion device outlet 119 and the primary inlet 301 of the ejector 304, via the junction 142. The solenoid valve 128 transfers hot vapor to the ejector primary inlet 301.

The CCRS 30 can operate in the following modes: Standby (thermolyze the evaporator 116 and heat loads 118 via heating or cooling); Cooling mode (heat load 118 on); Cooling mode (heat load 118 off); and Optional pump-down cycle. In Standby, the CCRS 30 maintains the heat load 118 at a temperature corresponding to the low end of the allowed operating temperature range.

In a thermolyzing-cooling operation, if ambient temperature is higher than the low end of the allowed operating temperature range for the high heat load 118, the CCRS 300 operates in a cooling mode. In the cooling mode, the solenoid valve 112 is open and the solenoid valve 128 is closed. When the ambient temperature is higher than the low end of the allowed temperature range for the high heat load 118, the TMS 300 is configured to have the CCRS 30 provide refrigeration to the high heat load 118. In this instance, the control system 999 produces signals to cause the solenoid valve 112 to open and solenoid valve 128 to close.

Circulating refrigerant enters the compressor 104 as a saturated or superheated vapor and is compressed to a higher pressure at a higher temperature (a superheated vapor). This superheated vapor is at a temperature and pressure at which it can be condensed in the condenser 106 by either cooling water 126 or cooling air 126 flowing across a coil or tubes in the condenser 106. At the condenser 106, the circulating refrigerant loses heat and thus removes heat from the system, which removed heat is carried away by either the water or air (whichever may be the case) flowing over the coil or tubes, providing a condensed liquid refrigerant.

The condensed and sub-cooled liquid refrigerant is routed into the receiver 110, exits the receiver 110, and enters via the solenoid valve 112. The primary inlet 301 of the ejector 304 is entrained with the refrigerant received at the secondary inlet 303 of the ejector 304 from the outlet of the evaporator 116 (with the evaporator 116 positioned as shown in FIG. 3). The heat from the high heat load 118, in thermal conductive and/or convective contact with or proximate to the evaporator 116, partially or completely evaporates the liquid portion of the two-phase liquid and vapor refrigerant mixture, and may superheat the two-phase liquid and vapor refrigerant mixture. The refrigerant leaves the evaporator 116 and enters the secondary inlet 303 of the ejector 304. The saturated or superheated vapor exits at the vapor-side outlet 127 of the liquid separator 124 and enters the compressor 104 completing the cycle. The expansion valve 114 may be controlled (e.g., by control system 999) to control pressure differential across the ejector.

In the case of the evaporator 116 placed in the modified configuration (as previously described), the liquid-vapor refrigerant mixture is routed through the evaporator 116 from the outlet 305 of the ejector 304, where heat is transferred from the high heat load 118 to partially or completely evaporate the liquid portion of the two-phase refrigerant mixture, and may superheat the mixture. The refrigerant leaves the evaporator 116 and enters the liquid separator 124. The saturated or superheated vapor exits at the vapor-side outlet 127 of the liquid separator 124 and enters the compressor 104 completing the cycle. Liquid refrigerant leaves the outlet 137 of the liquid separator 124 and enters secondary inlet 303 of the ejector 304.

Regardless of the placement of the evaporator 116, the temperature of the two-phase liquid and vapor refrigerant mixture (evaporating temperature) is lower than the temperature of the high heat load 118. The liquid-vapor refrigerant mixture is routed through the evaporator 116.

In a thermolyzing-heating operation, if ambient temperature is lower than the low end of the allowed operating temperature band, the CCRS 30 operates in a heating mode. In the heating mode, the solenoid valve 112 is closed and the solenoid valve 128 is open. When the ambient temperature is lower than the low end of the allowed temperature range for the high heat load 118, the TMS 300 is configured to have the CCRS 30 provide heat to the high heat load 118. In this instance, the control system 999 produces signals to cause the solenoid valve 112 to be closed and solenoid valve 128 to be open.

Circulating refrigerant enters the compressor 104 as a saturated or superheated vapor and is compressed to a higher pressure at a higher temperature (a superheated vapor). A first portion of the superheated vapor is at a temperature and pressure at which it can be condensed in the condenser 106 by either cooling water 126 or cooling air 126 flowing across a coil or tubes in the condenser 106. The condensed and sub-cooled first portion is now in a liquid refrigerant phase and is routed into the receiver 110, but does not exit the receiver 110, while the solenoid valve 112 is closed.

However, with the solenoid valve 128 open, a second portion of the hot superheated vapor is diverted to the primary inlet 301 of the ejector 304 The hot superheated vapor at the primary inlet 301 entrains liquid at the secondary inlet 303 from the evaporator 116 outlet (if the evaporator 116 is positioned as shown in FIG. 3). The hot superheated vapor heats the evaporator 116 and heat load 118, and evaporates liquid formed and accumulated in the liquid separator 124 at low ambient temperature. At the condenser 106, the first portion of the circulating refrigerant loses heat and thus removes heat from the CCRS 30, which removed heat is carried away by either the water 126 or air 126 (whichever may be the case) flowing over the coil or tubes, providing a condensed liquid refrigerant. The high heat load 118, in thermal conductive and/or convective contact with or proximate to the evaporator 116, is heated by the second portion of the superheated vapor. In this mode, the evaporator 116 is where the circulating refrigerant adds heat to the high heat load 118. To complete the refrigeration cycle, the refrigerant vapor from the ejector 304 exits the liquid separator 124 at the vapor-side outlet 127 and enters the compressor 104.

For cooling modes (heat load 118 ON or heat load 118 OFF), the CCRS 30 can be configured to engage both liquid and hot vapor streams to modulate needed cooling or heating effect by placing both solenoid valves 112, 128 open or both solenoid valves 112, 128 closed. Also, the CCRS 30 can be configured to adjust a speed of compressor 104 (as a variable speed compressor) to modulate needed cooling or heating capacity. When the heat load is ON, the solenoid valve 112 is open and the solenoid valve 128 is closed. The CCRS 30 is configured to generate cooling capacity which is less than the generated heat load. As a result, the heat load temperature rises until it reaches the high end of the allowed operating temperature range during the period of the heat load performance. When the heat load is OFF, the solenoid valve 112 is closed and the solenoid valve 128 is opened, and the CCRS 30 continues to operate until the temperature reaches the low end of the allowed operating temperature range.

In an optional pump down operation, a pump-down cycle may be used to return liquid refrigerant that accumulates in the liquid separator 124 back to the receiver 110. In order to prevent quick reduction of the suction pressure during pump-down cycle, the solenoid valve 128 may be opened. If the expansion valve 114 is configured to operate at a superheat, then the liquid separator 124 and the pump-down cycle may not be needed. If the compressor capacity exceeds the hot vapor capacity demand, the suction pressure and/or discharge pressure may hit the limit: suction pressure reduce below the low-pressure limit and discharge pressure exceeds the high-pressure limit. One way to prevent that is to reduce the speed of the compressor. Another way to do that is to flow some amount of liquid refrigerant via the expansion valve 114 (as controlled, e.g., by the control system 999). This increases the overall mass flow rate circulating flow rate, decrease the temperature of refrigerant entering the evaporator 116, but keep the same hot vapor capacity.

Figure 4:
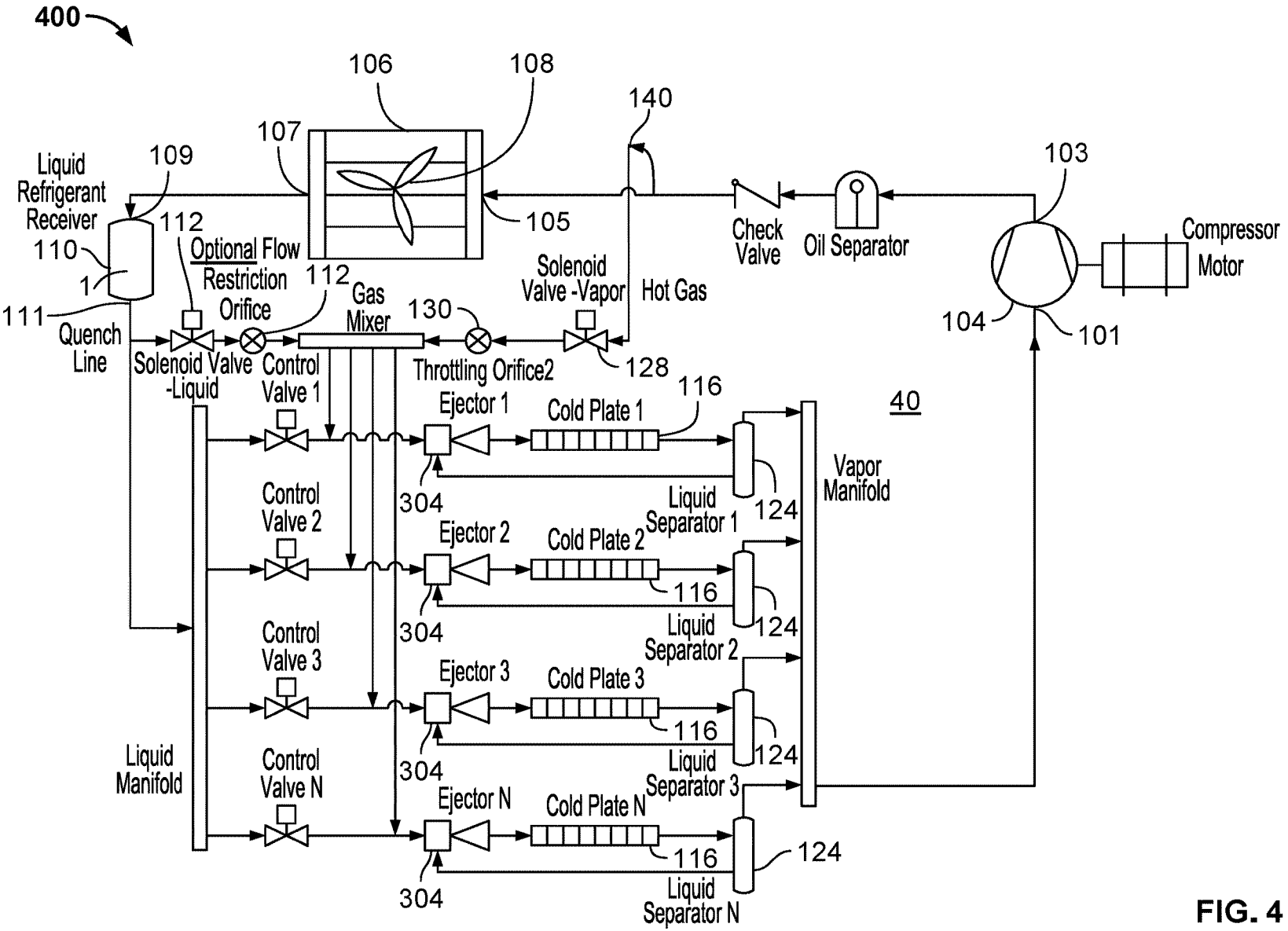

Referring now to FIG. 4, this figures shows TMS 400 with CCRS 40, which is an alternative ejector assist-based system to the TMS 300 shown in FIG. 3. Common components between TMS 300 and TMS 400 have been numbered accordingly, with components unique to TMS 400 being labeled. TMS 400 includes a gas mixer and multiple control valves (1-to-n) fed at inlets by a liquid manifold downstream of receiver 110 with outlets of the control valves connected to one or more liquid outlets of the gas mixer. TMS 400 includes multiple ejectors 304 (1-to-n), multiple evaporators 116 (e.g., cold plates) (1-to-n), and multiple liquid separators 124 (1-to-n). The gas mixer mixes the hot vapor with the liquid, and the liquid cools the gas at a high pressure. As a result, the overall mass flow rate in TMS 400 is increased, the hot vapor temperature is decreased, and the overall hot vapor capacity remains the same (compared to TMS 300).

Figure 5:
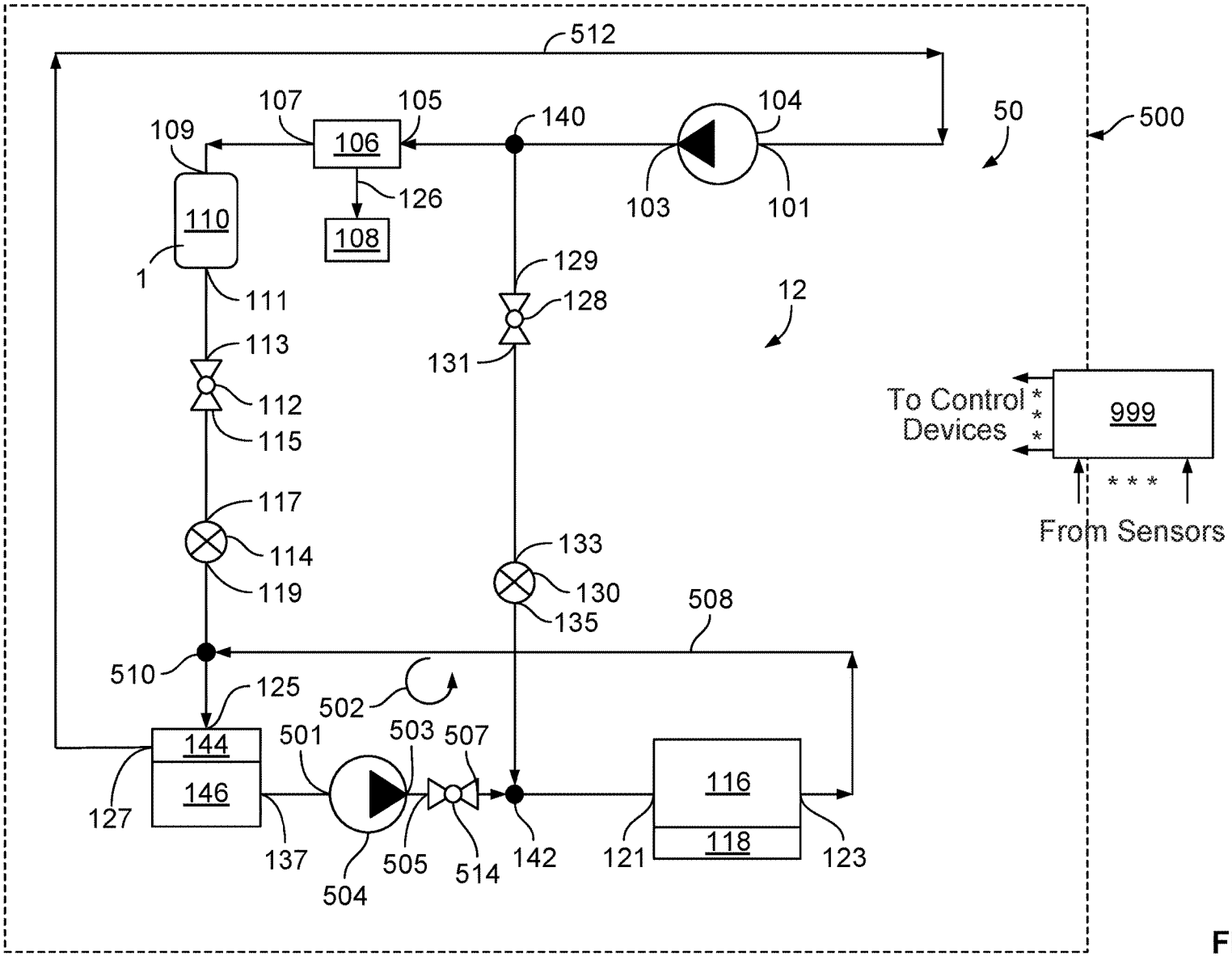

Referring to FIG. 5, a thermal management system (TMS) 500 includes a closed-circuit refrigeration system (CCRS) 50. TMS 500 provides closed-circuit refrigeration for one or more heat loads 118, e.g., high heat loads over short-time intervals, with a pump assist circuit 502. Thus, in FIG. 5, a pump 504 is used with a liquid separator 124 (in place of a suction accumulator).

Components shown in the TMS 500 that are also included in TMS 100-TMS 300 generally have the same structure and function as described with reference to FIGS. 1A, 2, and 3. In some aspects, although not shown, the oil circuit from FIG. 1A can be implemented in FIG. 5 as well.

As shown in FIG. 5, the pump assist circuit 502 includes a pump 504 with an inlet 501 and an outlet 503. The optional solenoid valve 112 feeds refrigerant liquid from the receiver 110 into expansion valve 114. Refrigerant at the outlet 119 of the expansion valve 114 is fed to one of two inlets of a three-port junction 510, with the second of the two inlets coupled to the outlet 123 of the evaporator 116. The junction 510 also includes an outlet that feeds refrigerant from the receiver 110 and the evaporator 116 to the inlet 125 of the liquid separator 124. The pump inlet 501 receives refrigerant liquid from the liquid-side outlet 137 of the liquid separator 124.

The pump outlet 503 outputs the refrigerant into an inlet 6505 of an optional solenoid valve 514. An outlet 507 of the solenoid valve 514 feeds the refrigerant into one of the inlets of the junction 142, with the second inlet of the junction 142 receiving refrigerant from outlet 135 of expansion valve 130. The expansion valve 130 includes inlet 133 that is coupled to the outlet 131 of solenoid valve 128. The vapor-side outlet 127 of the liquid separator 124 feeds refrigerant vapor into the inlet 101 of the compressor 104. The outlet 103 of the compressor 104 feeds junction 140, with the outlets of the junction 140 coupled to the inlet 105 of the condenser 106 and inlet 129 of the solenoid valve 128. The evaporator 116 is coupled, via the junction 142, to the pump outlet 503 and the outlet of the expansion valve 130 by junction 142. In this configuration, the pump 504 pumps liquid refrigerant from the liquid-side outlet 137 of the liquid separator 124 to the junction 142 and towards the inlet 121 of the evaporator 116.

In some aspects, pump 504 is located distal from the liquid-side outlet 137. This configuration potentially presents the possibility of cavitation. To minimize the possibility of cavitation. other configurations can also be used. For example, the pump 504 can be located distal from the liquid-side outlet 137, but the height at which the inlet 125 is located is relatively high in the liquid separator 124. This would result in an increase in liquid pressure at the liquid-side outlet 137 of the liquid separator 124 and concomitant therewith an increase in liquid pressure at the inlet 501 of the pump 504. Increasing the pressure at the inlet 501 to the pump 504 should minimize possibility of cavitation. As another example, the pump 504 can be located proximate to or indeed inside of the liquid-side outlet 137. In addition, the height at which the inlet 125 is located can be relatively high as well. This would result in an additional increase in liquid pressure at the inlet 501 of the pump 504 further minimizing the possibility of cavitation. Another alternative strategy that can be used for any pump configuration involves the use of a sensor that produces a signal that is a measure of the height of a column of liquid in the liquid separator 124. The signal is sent to the control system 999 that will be used to start the pump 504, once a sufficient height of liquid is contained by the liquid separator 124. Another alternative strategy that can be used for any of the pump configurations involves the use of a heat exchanger in liquid separator 124. The heat exchanger is an evaporator, which brings in thermal contact two refrigerant streams. In the above systems, a first of the streams is the liquid stream leaving the liquid separator 124. A second stream is the liquid refrigerant expanded to a pressure lower than the evaporator pressure in the evaporator 116 and evaporating the related evaporating temperature lower than the liquid temperature at the liquid separator exit. Thus, the liquid from the liquid separator 124 exit is subcooled rejecting thermal energy to the second side of the heat exchanger. The second side absorbs the rejected thermal energy due to evaporating and superheating of the second refrigerant stream.

The CCRS 50 can operate in the following modes: Standby (thermolyze the evaporator 116 and heat loads 118 via heating or cooling); Cooling mode (heat load 118 on); Cooling mode (heat load 118 off); and Optional pump-down cycle. In Standby, the CCRS 50 maintains the heat load 118 at a temperature corresponding to the low end of the allowed operating temperature range.

In a thermolyzing-cooling operation, if ambient temperature is higher than the low end of the allowed operating temperature range for the high heat load 118, the CCRS 50 operates in a cooling mode. In the cooling mode, the solenoid valve 112 is open and the solenoid valve 128 is closed. When the ambient temperature is higher than the low end of the allowed temperature range for the high heat load 118, the TMS 500 is configured to have the CCRS 50 provide refrigeration to the high heat load 118. In this instance, the control system 999 produces signals to cause the solenoid valve 112 to open and solenoid valve 128 to close.

Circulating refrigerant enters the compressor 104 as a saturated or superheated vapor and is compressed to a higher pressure at a higher temperature (a superheated vapor). This superheated vapor is at a temperature and pressure at which it can be condensed in the condenser 106 by either cooling water 126 or cooling air 126 flowing across a coil or tubes in the condenser 106. At the condenser 106, the circulating refrigerant loses heat and thus removes heat from the CCRS 50, which removed heat is carried away by either the water 126 or air 126 (whichever may be the case) flowing over the coil or tubes, providing a condensed, sub-cooled liquid refrigerant.

The condensed, sub-cooled liquid refrigerant is routed into the receiver 110, exits the receiver 110, and enters the solenoid valve 112 and the expansion valve 114. The refrigerant is enthalpically expanded in the expansion valve 114. The expanded refrigerant exits the expansion valve 114, enters junction 510, and is mixed in the junction 510 with a liquid/vapor refrigerant mixture that exits the evaporator 116. The high pressure sub-cooled liquid refrigerant turns into liquid-vapor mixture at a low pressure and temperature and exits the junction 510. The temperature of the liquid-vapor mixture (evaporating temperature) is lower than the temperature of the high heat load 118. The liquid-vapor mixture is routed through the evaporator 116. The heat from the high heat load 118, in thermal conductive and/or convective contact with or proximate to the evaporator 116, partially or completely evaporates the liquid portion of the two-phase liquid-vapor mixture, and may superheat the liquid-vapor mixture. The refrigerant leaves the evaporator 116 and enters junction 510 through conduit 508.

Saturated or superheated vapor exits the liquid separator 124 at the vapor-side outlet 127 enters the compressor 104 through conduit 512. The evaporator 116 is where the circulating refrigerant absorbs and removes heat from the high heat load 118, which heat is subsequently rejected in the condenser 106 and transferred to an ambient by water or air used in the condenser 106. To complete the refrigeration cycle, the refrigerant vapor from the evaporator 116 exits the liquid separator 124 at the vapor-side outlet 127 and enters the compressor 104.

In a thermolyzing-heating operation, if ambient temperature is lower than the low end of the allowed operating temperature band, the CCRS 50 operates in a heating mode. In the heating mode, the solenoid valve 112 is closed and the solenoid valve 128 is open. When the ambient temperature is lower than the low end of the allowed temperature range for the high heat load 118, the TMS 500 is configured to have the CCRS 50 provide heat to the high heat load 118. In this instance, the control system 999 produces signals to cause the solenoid valve 112 to be closed and solenoid valve 128 to be open.

Circulating refrigerant enters the compressor 104, as a saturated or superheated vapor, and is compressed to a higher pressure at a higher temperature (a superheated vapor). A first portion of the superheated vapor is at a temperature and pressure at which it can be condensed in the condenser 106 by either cooling water 126 or cooling air 126 flowing across a coil or tubes in the condenser 106. At the condenser 106, the first portion of the circulating refrigerant loses heat and thus removes heat from the CCRS 50, which removed heat is carried away by either the water 126 or air 126 (whichever may be the case) flowing over the coil or tubes, providing a condensed liquid refrigerant. The condensed and sub-cooled first portion is now in a liquid refrigerant phase and is routed into the receiver 110, but does not exit the receiver 110, while the solenoid valve 112 is closed.

However, with the solenoid valve 128 open, a second portion of the superheated vapor is diverted through the expansion valve 130 back to the evaporator 116, where it heats the high heat load 118. The high heat load 118, in thermal conductive and/or convective contact with or proximate to the evaporator 116, is heated by the second portion of the superheated vapor. The refrigerant leaves the evaporator 116 and enters the inlet 125 of the liquid separator 124. The liquid-side outlet 137 delivers liquid refrigerant to the pump 504. The pump 504, is in an off state and does not pump the liquid refrigerant into solenoid valve 514. The solenoid valve 514 is optional, provided that the pump 504 can block liquid when not in use. The saturated or superheated vapor exits the liquid separator 124 and enters the compressor 104 through conduit 512. In this mode, the evaporator 116 is where the circulating refrigerant adds heat to the high heat load 118. To complete the refrigeration cycle, the refrigerant vapor from the evaporator 116 exits the liquid separator 124 at the vapor-side outlet 127 and enters the compressor 104.

The CCRS 50 can be configured to engage both liquid and hot vapor streams to modulate needed cooling or heating effect by placing both solenoid valves 112, 128 open or both solenoid valves 112, 128 closed. Also, the CCRS 50 can be configured to adjust a speed of the compressor 104 (if variable speed) to modulate needed cooling or heating capacity.

When the heat load 118 is ON, the solenoid valve 112 is open and the solenoid valve 128 is closed. The CCRS 50 is configured to generate cooling capacity which is less than the generated heat load 118. As a result, the heat load temperature rises until it reaches the high end of the allowed operating temperature range during the period of the heat load performance.

When the heat load 118 is OFF, the solenoid valve 112 is off and the solenoid valve 128 is opened, and the CCRS 50 continues to operate until the temperature reaches the low end of the allowed operating temperature band.

In an optional pump down operation, a pump-down cycle may be used to return liquid refrigerant that accumulates in the liquid separator 124 back to the receiver 110. In order to prevent quick reduction of the suction pressure during pump-down cycle, the solenoid valve 128 may be opened. If the expansion valve 114 is configured to operate at a superheat, then the liquid separator 124 and the pump-down cycle may not be needed.

Figure 6:
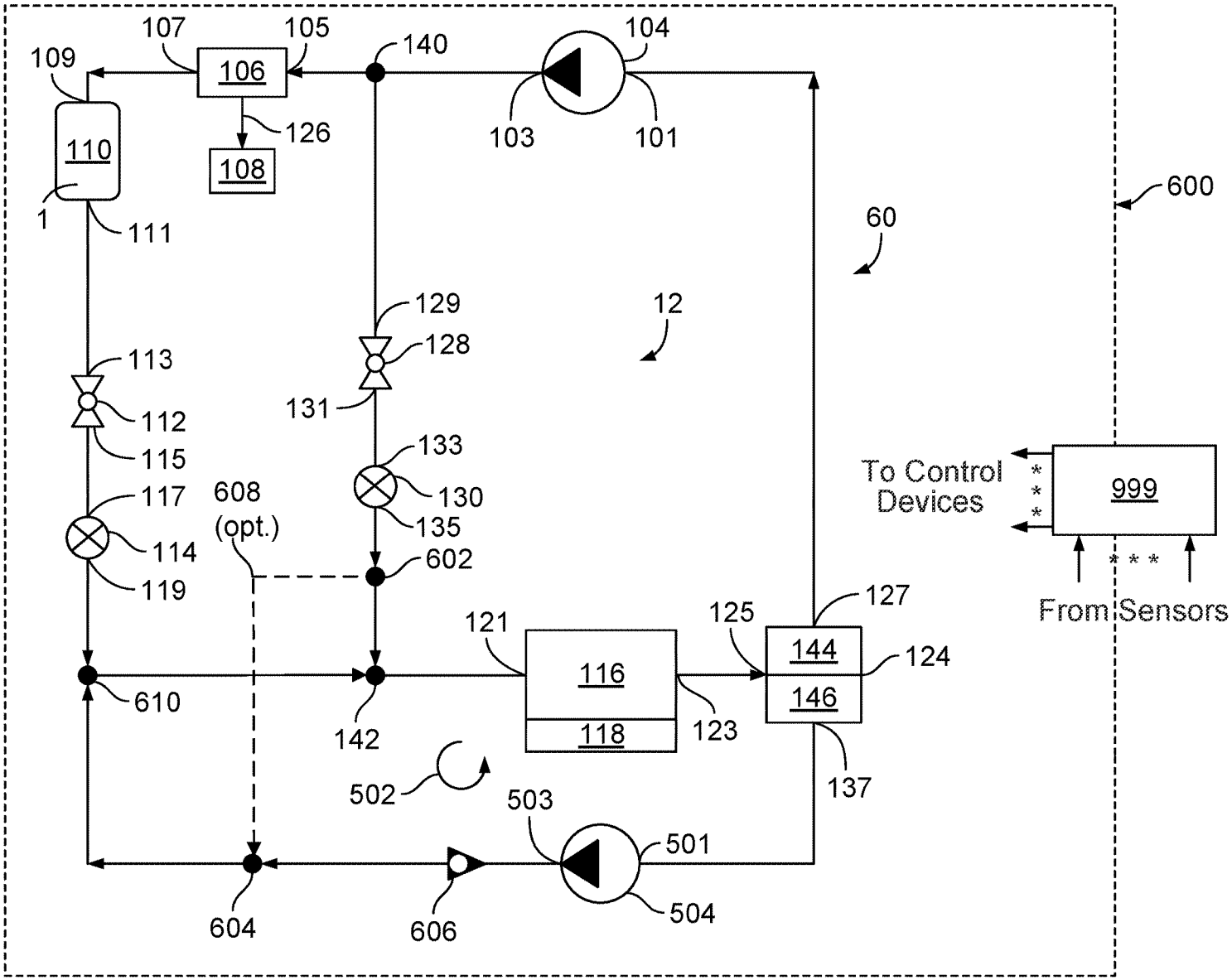

Referring to FIG. 6, a thermal management system (TMS) 600 includes a closed-circuit refrigeration system (CCRS) 60. TMS 600 provides closed-circuit refrigeration for one or more heat loads 118, e.g., high heat loads over short-time intervals, with a pump assist circuit 502 as well. Thus, in FIG. 6, a pump 504 is used with a liquid separator 124 (in place of a suction accumulator).

Components shown in the TMS 600 that are also included in TMS 100-TMS 300 and TMS 500 generally have the same structure and function as described with reference to FIGS. 1A, 2, 3, and 5. In some aspects, although not shown, the oil circuit from FIG. 1A can be implemented in FIG. 6 as well.

As shown in FIG. 6, the pump assist circuit 502 includes pump 504 with inlet 501 and outlet 503, as well optional check valve 606 and junctions 604 and 610. The optional solenoid valve 112 feeds refrigerant liquid from the receiver 110 into the expansion valve 114. Refrigerant at the outlet 119 of the expansion valve 114 is fed to one of two inlets of the three-port junction 610. The junction 610 also includes an outlet that feeds refrigerant from the receiver 110 and the evaporator 116 toward the inlet 125 of the liquid separator 124.

The second of the two inlets of the three-port junction 610 is coupled to the outlet 503 of the pump 504, via a first inlet of three-port junction 604 and optional check valve 606. The three-port junction 604 has a second inlet that is coupled to an outlet of another three-port junction 602 through conduit 608. The check valve 606 is arranged such that refrigerant passes from the pump outlet 503 through the check valve 606, but any refrigerant from the hot vapor circuit 12, via the junction 602, is inhibited from passing to the pump outlet 503. The junction 142 also includes an outlet that feeds the refrigerant from the receiver 110 and the refrigerant from the pump outlet 503 into the inlet 121 of the evaporator 116. The outlet 123 of the evaporator 116 feeds refrigerant into the inlet 125 of the liquid separator 124.

The pump outlet 503 outputs the refrigerant into an inlet of the check valve 606. An outlet of the check valve 606 feeds the refrigerant into one of the inlets of the junction 604 with the second inlet of the junction 142 receiving refrigerant from expansion valve 130 of hot vapor circuit 12. The expansion valve 130 includes inlet 133 that is coupled to the solenoid valve 128 at outlet 131. The vapor-side outlet 127 of the liquid separator 124 feeds refrigerant vapor into the inlet 101 of the compressor 104. In this configuration, the pump 504 also pumps liquid refrigerant from the liquid-side outlet 137 of the liquid separator 124 towards the evaporator 116.

The CCRS 60 can operate in the following modes: Standby (thermolyze the evaporator 116 and heat loads 118 via heating or cooling); Cooling mode (heat load 118 on); Cooling mode (heat load 118 off); and Optional pump-down cycle. In Standby, the CCRS 60 maintains the heat load 118 at a temperature corresponding to the low end of the allowed operating temperature range.

In a thermolyzing-cooling operation, if ambient temperature is higher than the low end of the allowed operating temperature range for the high heat load 118, the CCRS 60 operates in a cooling mode. In the cooling mode, the solenoid valve 112 is open and the solenoid valve 128 is closed. When the ambient temperature is higher than the low end of the allowed temperature range for the high heat load 118, the TMS 600 is configured to have the CCRS 60 provide refrigeration to the high heat load 118. In this instance, the control system 999 produces signals to cause the solenoid valve 112 to open and solenoid valve 128 to close.

Circulating refrigerant enters the compressor 104 as a saturated or superheated vapor and is compressed to a higher pressure at a higher temperature (a superheated vapor). The condensed, sub-cooled liquid refrigerant is routed into the receiver 110, exits the receiver 110, and enters the solenoid valve 112 and the expansion valve 114. The refrigerant is enthalpically expanded in the expansion valve 114. The expanded refrigerant exits the expansion valve 114, enters junction 610, and is mixed in the junction 610 with liquid refrigerant from the outlet 503 of the pump 504, via the check valve 606. The liquid and vapor refrigerant mixture from an outlet of the junction 610 is fed to the inlet 121 of the evaporator 116. The temperature of the liquid and vapor refrigerant mixture (evaporating temperature) is lower than the temperature of the high heat load 118. The liquid and vapor refrigerant mixture is routed through the evaporator 116. The heat from the high heat load 118, in thermal conductive and/or convective contact with or proximate to the evaporator 116, partially or completely evaporates the liquid portion of the liquid and vapor refrigerant mixture, and may superheat the liquid and vapor refrigerant mixture. The liquid and vapor refrigerant mixture (now mostly vapor) leaves the evaporator 116 and enters the liquid separator 124.

Saturated or superheated vapor exits the liquid separator 124 at the vapor-side outlet 127 and enters the compressor 104. The evaporator 116 is where the circulating refrigerant absorbs and removes heat from the high heat load 118, which heat is subsequently rejected in the condenser 106 and transferred to an ambient by water 126 or air 126 used in the condenser 106. To complete the refrigeration cycle, the refrigerant vapor from the evaporator 116 exits the liquid separator 124 at the vapor-side outlet 127 and enters the compressor 104.

In a thermolyzing-heating operation, if ambient temperature is lower than the low end of the allowed operating temperature band, the CCRS 60 operates in a heating mode. In the heating mode, the solenoid valve 112 is closed and the solenoid valve 128 is open. When the ambient temperature is lower than the low end of the allowed temperature range for the high heat load 118, the TMS 600 is configured to have the CCRS 60 provide heat to the high heat load 118. In this instance, the control system 999 produces signals to cause the solenoid valve 112 to be closed and solenoid valve 128 to be open.

Circulating refrigerant enters the compressor 104 as a saturated or superheated vapor and is compressed to a higher pressure at a higher temperature (a superheated vapor). A first portion of the superheated vapor is at a temperature and pressure at which it can be condensed in the condenser 106 by either cooling water 126 or cooling air 126 flowing across a coil or tubes in the condenser 106. At the condenser 106, the first portion of the circulating refrigerant loses heat and thus removes heat from the CCRS 60, which removed heat is carried away by either the water 126 or air 126 (whichever may be the case) flowing over the coil or tubes, providing a condensed liquid refrigerant. The condensed and sub-cooled first portion is now in a liquid refrigerant phase and is routed into the receiver 110, but does not exit the receiver 110, while the solenoid valve 112 is closed.

However, with the solenoid valve 128 open, a second portion of the superheated vapor is diverted back to the evaporator 116 where it heats the high heat load 118. Meanwhile, the high heat load 118, in thermal conductive and/or convective contact with or proximate to the evaporator 116, is heated by the second portion of the superheated vapor. The refrigerant leaves the evaporator 116 and enters the inlet 125 of the liquid separator 124. The liquid-side outlet 137 delivers liquid refrigerant to the pump 504. The pump 504, is in an off state and does not pump the liquid refrigerant into check valve 606. The saturated or superheated vapor exits the liquid separator 124 at the vapor-side outlet 127, and enters the compressor 104. In this mode, the evaporator 116 is where the circulating refrigerant adds heat to the high heat load 118. To complete the refrigeration cycle, the refrigerant vapor from the evaporator 116 exits the liquid separator 124 at the vapor-side outlet 127 and enters the compressor 104.

The CCRS 60 can be configured to engage both liquid and hot vapor streams to modulate needed cooling or heating effect by placing both solenoid valves 112, 128 open or both solenoid valves 112, 128 closed. Also, the CCRS 60 can be configured to adjust a speed of compressor 104 (if variable speed) to modulate needed cooling or heating capacity.

When the heat load 118 is ON, the solenoid valve 112 is open and the solenoid valve 128 is closed. The CCRS 60 is configured to generate cooling capacity which is less than the generated heat load 118. As a result, the heat load temperature rises until it reaches the high end of the allowed operating temperature range during the period of the heat load performance.

When the heat load 118 is OFF, the solenoid valve 112 is closed and the solenoid valve 128 is opened, the CCRS 60 continues to operate until the temperature reaches the low end of the allowed operating temperature band.

In an example pump down operation, a pump-down cycle may be used to return liquid refrigerant that accumulates in the liquid separator 124 back to the receiver 110. In order to prevent quick reduction of the suction pressure during pump-down cycle, the solenoid valve 128 may be opened. If the expansion valve 114 is configured to operate at a superheat, then the liquid separator 124 and the pump-down cycle may not be needed.

Figure 7B:
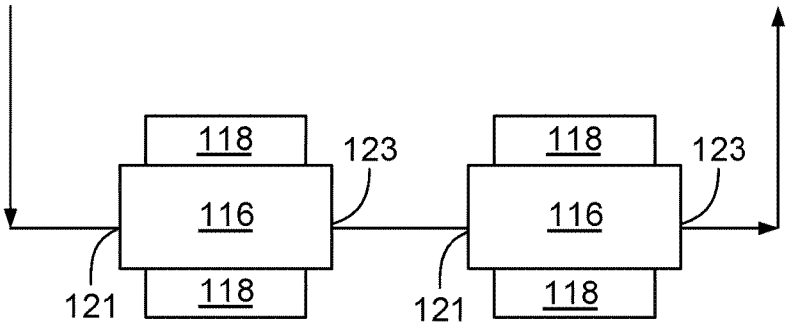
Figure 7C:
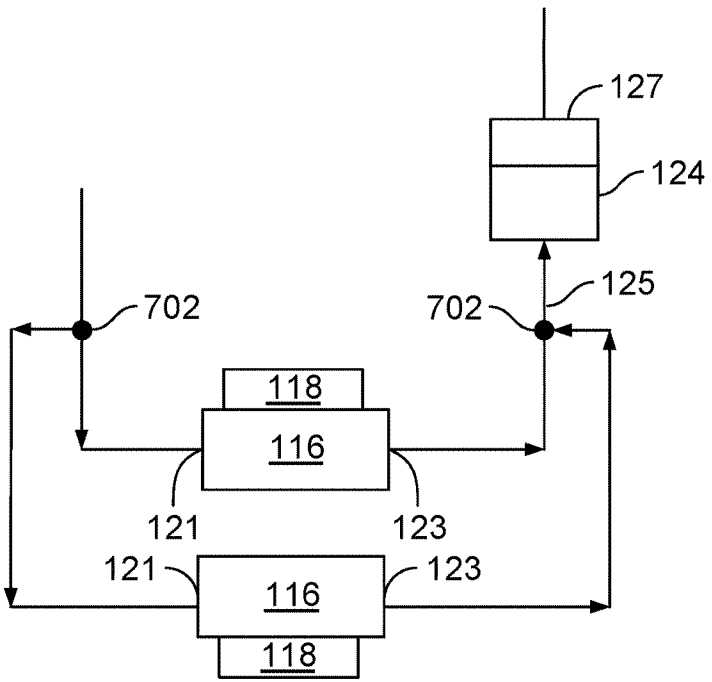
Figure 7D:
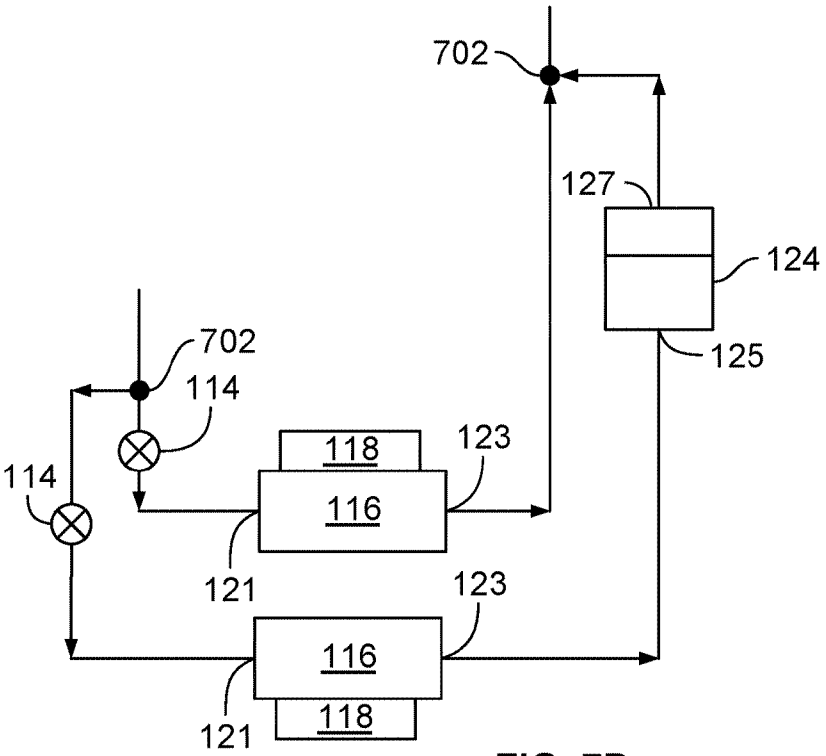

Referring now to FIGS. 7A-7D additional evaporator arrangements that are alternative configurations of the evaporator 116 and heat load(s) 118 are shown. In the configuration of FIG. 7A, multiple high heat loads 118 are coupled to (or are in proximately to) a single, i.e., the same, evaporator 116. In the configuration of FIG. 7B, each of a pair of evaporators 116 is coupled to the high heat load 118 or to each high heat load 118 if there are multiple. In the configurations of FIGS. 7C and 7D, the high heat load 118 is thermally coupled (or proximate) to corresponding both of the pair of evaporators 116 or each of a pair of high heat loads 118 is thermally coupled to a respective evaporator 116. In the configurations of FIGS. 7C and 7D, a T-valve 702 (passive or active), as shown, splits refrigerant flow from the receiver 110, into two paths that feed two evaporators 116 and heat load 118. The liquid separator 124 could also be used in either of the configurations of FIGS. 7C and 7D. As also shown in FIG. 7D expansion valves are coupled at inlet sides of the evaporators 116. At least one expansion valve would be configured to control a vapor quality at the evaporator 116 exit to allow discharging liquid into the suction accumulator, while the other would controls a superheat. Other configurations are possible. In the configuration of FIG. 7C, the outlets 123 of the evaporators 116 are coupled to a second T-valve 702 (active or passive) that has an output that feeds the inlet 125 of the suction accumulator 124. On the other hand, in the configuration of FIG. 7D, the outlets 123 of the evaporators 116 are coupled differently. The outlet 123 of one evaporator 116 with high heat load 118 feeds an inlet of the T-valve 702, whereas the outlet 123 of another evaporator 116 with another high heat load 118 feeds inlet 125 of the suction accumulator 124. This arrangement in effect, removes the liquid separator 124 from one of the paths of the evaporators 116. In some configurations, the T valves 702 can be switched (meaning that they can be controlled (automatically or manually) to shut off either or both inlets) or passive meaning that they do not shut off either inlet and thus can be T junctions.

Regarding refrigerant vapor quality and with respect to any of the example implementations of a TMS according to the present disclosure, the vapor quality of the refrigerant fluid 1 after passing through evaporator 116 can be controlled either directly or indirectly with respect to a vapor quality set point by the control system 999. The evaporator 116 may be configured to maintain exit vapor quality substantially below the critical vapor quality defined as "1."

Vapor quality is the ratio of mass of vapor to mass of liquid+vapor and is generally kept in a range of approximately 0.5 to almost 1.0; more specifically 0.6 to 0.95; more specifically 0.75 to 0.9 more specifically 0.8 to 0.9 or more specifically about 0.8 to 0.85. "Vapor quality" is thus defined as mass of vapor/total mass (vapor+liquid). In this sense, vapor quality cannot exceed "1" or be equal to a value less than "0." In practice vapor quality may be expressed as "equilibrium thermodynamic quality" that is calculated as follows:

$$X=(h-h')/(h''-h'),$$

where h is specific enthalpy, specific entropy or specific volume, h' is of saturated liquid and " is of saturated vapor. In this case X can be mathematically below 0 or above 1, unless the calculation process is forced to operate differently. Either approach is acceptable.

During operation of a TMS, cooling can be initiated by a variety of different mechanisms. In some embodiments, for example, a TMS includes temperature sensors attached to loads 118 (as will be discussed subsequently). When the temperature of loads 118 exceeds a certain temperature set point (i.e., threshold value), the control system 999 connected to the temperature sensor can initiate cooling of loads 118. Alternatively, in certain embodiments, a TMS operates essentially continuously—provided that the refrigerant fluid pressure within receiver 110 is sufficient—to cool low high heat load 118 and a temperature sensor attached to high heat load 118 will cause the control system 999 to switch the operating mode of a CCRS when the temperature of high heat load 118 exceeds a certain temperature set point (i.e., threshold value). As soon as receiver 110 is charged with refrigerant fluid, refrigerant fluid is ready to be directed into evaporator 116 to cool high heat load 118. In general, cooling is initiated when a user of the system or the heat load issues a cooling demand.

Upon initiation of a cooling operation, refrigerant fluid from receiver 110 is discharged from an outlet, through an optional solenoid valve, if present, and is transported through conduit to expansion valve 114, which directly or indirectly controls vapor quality (or superheat) at the evaporator outlet. In the following discussion, expansion valve 114 is implemented as an electronic expansion valve device. However, it should be understood that more generally, expansion valve 114 can be implemented as any component or device that performs the functional steps described below and provides for vapor quality control (or superheat) at the evaporator outlet.

Once inside the expansion valve 114, the refrigerant fluid undergoes constant enthalpy expansion from an initial pressure $p_r$ (i.e., the receiver pressure) to an evaporation pressure $p_e$ at the outlet of the expansion valve 114. In general, the evaporation pressure $p_e$ depends on a variety of factors, e.g., the desired temperature set point value (i.e., the target temperature) at which high heat load 118 is/are to be maintained and the heat input generated by the respective heat loads. Set points will be discussed below.

The initial pressure in the receiver 110 tends to be in equilibrium with the surrounding temperature and is different for different refrigerants. (Operational conditions of the compressor 104 and condenser 106 may be configured to maintain a higher condensing pressure.) The pressure in the evaporator 116 depends on the evaporating temperature, which is lower than the heat load temperature and is defined during design of a TMS. A TMS is operational as long as the receiver-to-evaporator pressure difference is sufficient to drive adequate refrigerant fluid flow through the expansion valve 114. After undergoing constant enthalpy expansion in the expansion valve 114, the liquid refrigerant fluid is converted to a mixture of liquid and vapor phases at the temperature of the fluid and evaporation pressure $p_e$. The two-phase refrigerant fluid mixture is transported via conduit to evaporator 116.

When the two-phase mixture of refrigerant fluid is directed into evaporator 116, the liquid phase absorbs heat from load 118, driving a phase transition of the liquid refrigerant fluid into the vapor phase. Because this phase transition occurs at (nominally) constant temperature, the temperature of the refrigerant fluid mixture within evaporator 116 remains unchanged, provided at least some liquid refrigerant fluid remains in evaporator 116 to absorb heat.

Further, the constant temperature of the refrigerant fluid mixture within evaporator 116 can be controlled by adjusting the pressure $p_e$ of the refrigerant fluid, since adjustment of $p_e$ changes the boiling temperature of the refrigerant fluid. Thus, by regulating the refrigerant fluid pressure $p_e$ upstream from evaporator 116, the temperature of the refrigerant fluid within evaporator 116 (and, nominally, the temperature of high heat load 118) can be controlled to match a specific temperature set-point value for high heat load 118, ensuring that high heat load 118 is maintained at, or very near, a target temperature.

The pressure drop across the evaporator 116 causes drop of the temperature of the refrigerant mixture (which is the evaporating temperature), but still the evaporator 116 can be configured to maintain the heat load temperature within the set tolerances.

In some embodiments, for example, the evaporation pressure of the refrigerant fluid can be adjusted by pressure of the back-pressure regulator 36 to ensure that the temperature of heat loads 25 is maintained to within ±5 degrees C. (e.g., to within ±4 degrees C., to within ±3 degrees C., to within ±2 degrees C., to within ±1 degree C.) of the temperature set point value for load 49.

As discussed above, within evaporator 116, a portion of the liquid refrigerant in the two-phase refrigerant fluid mixture is converted to refrigerant vapor by undergoing a phase change. As a result, the refrigerant fluid mixture that emerges from evaporator 116 has a higher vapor quality (i.e., the fraction of the vapor phase that exists in refrigerant fluid mixture) than the refrigerant fluid mixture that enters evaporator 116.

As the refrigerant fluid mixture emerges from evaporator 116, a portion of the refrigerant fluid can optionally be used to cool one or more additional heat loads. Typically, for example, the refrigerant fluid that emerges from evaporator 116 is nearly in the vapor phase. The refrigerant fluid vapor (or, more precisely, high vapor quality fluid vapor) can be directed into a heat exchanger coupled to another heat load, and can absorb heat from the additional heat load during propagation through the heat exchanger.

A variety of different refrigerant fluids can be used in a TMS. Depending on the application, emissions regulations and operating environments may limit the types of refrigerant fluids that can be used. More generally, any fluid can be used as a refrigerant in the closed-circuit refrigeration systems disclosed herein, provided that the fluid is suitable for cooling heat loads 25 (e.g., the fluid boils at an appropriate temperature) and, in embodiments where the refrigerant fluid is exhausted directly to the environment, regulations and other safety and operating considerations do not inhibit such discharge. For example, in certain embodiments, the refrigerant fluid can be ammonia having very large latent heat; after passing through the cooling circuit, the ammonia refrigerant vapor in the closed-circuit operation can be disposed of by incineration, by chemical treatment (i.e., neutralization), and/or by direct venting to the atmosphere. In certain embodiments, the refrigerant fluid can be an ammonia-based mixture that includes ammonia and one or more other substances. For example, mixtures can include one or more additives that facilitate ammonia absorption or ammonia burning.

Ammonia under standard conditions of pressure and temperature is in a liquid or two-phase state. Thus, the receiver 110 typically will store ammonia at a saturated pressure corresponding to the surrounding temperature. The pressure in the receiver 110 storing ammonia will change during operation. The use of the expansion valve 114 can stabilize pressure in the receiver 110 during operation, by adjusting the expansion valve 114 (e.g., automatically or by control system 999) based on a measurement of the evaporation pressure ($p_e$) of the refrigerant fluid and/or a measurement of the evaporation temperature of the refrigerant fluid.

Figure 8:
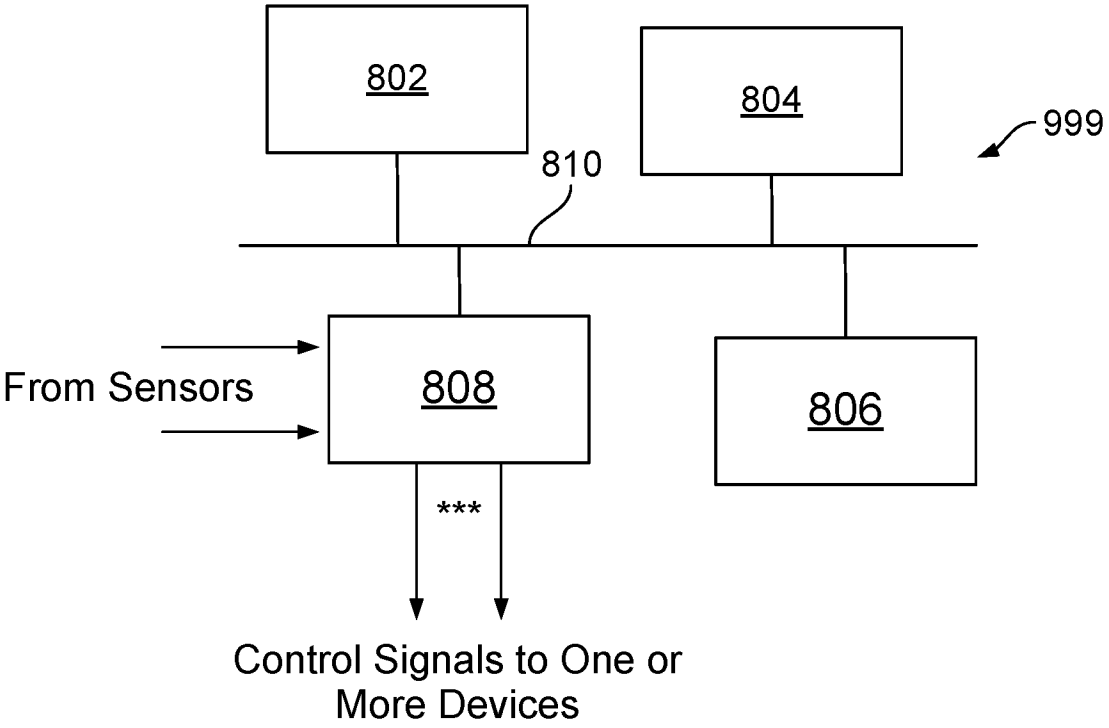
FIG. 8 is a block diagram of a control system or controller for a thermal management system according to the present disclosure.

FIG. 8 shows the control system 999 that includes a processor 802, memory 804, storage 806, and I/O interfaces 808, all of which are connected/coupled together via a bus 810. Any two of the optional devices, as pressure sensors, upstream and downstream from a control device, can be configured to measure information about a pressure differential $p_r$-$p_e$ across the respective control device and to transmit electronic signals corresponding to the measured pressure from which a pressure difference information can be generated by the control system 999. Other sensors such as flow sensors and temperature sensors can be used as well. In certain embodiments, sensors can be replaced by a single pressure differential sensor, a first end of which is connected adjacent to an inlet and a second end of which is connected adjacent to an outlet of a device to which differential pressure is to be measured, such as the evaporator. The pressure differential sensor measures and transmits information about the refrigerant fluid pressure drop across the device, e.g., the evaporator 116.

Control system 999 can adjust expansion valve 114 based on measurements of one or more of the following system parameter values: the pressure drop ($p_r$–$p_e$) across expansion valve 114, the pressure drop across evaporator 116, the refrigerant fluid pressure in receiver 110 ($p_r$), the vapor quality of the refrigerant fluid emerging from evaporator 116 (or at another location in the system), the superheat value of the refrigerant fluid in the system, the evaporation pressure ($p_e$) of the refrigerant fluid, and the evaporation temperature of the refrigerant fluid.

To adjust expansion valve 114 based on a particular value of a measured system parameter value, control system 999 compares the measured value to a range of set point values (or threshold values) for the system parameter, as will be discussed below.

Since liquid refrigerant temperature is sensitive to ambient temperature, the density of liquid refrigerant changes even though the pressure in the receiver 110 remains the same. Also, the liquid refrigerant temperature impacts the vapor quality at the evaporator inlet. Therefore, the refrigerant mass and volume flow rates change and the expansion valve 114 can be used to adjust for the changes.

Various combinations of the sensors can be used to measure thermodynamic properties of a TMS that are used to adjust expansion valves and/or pumps discussed above and which signals are processed by the control system 999. Connections (wired or wireless) are provided between each of the sensors and control system 999. In many embodiments, system includes only certain combinations of the sensors (e.g., one, two, three, or four of the sensors) to provide suitable control signals for the control devices.

Temperature sensors can be positioned adjacent to an inlet or an outlet of e.g., the evaporator 116 or between the inlet and the outlet. Such a temperature sensor measures temperature information for the refrigerant fluid within evaporator 116 (which represents the evaporating temperature) and transmits an electronic signal corresponding to the measured information. A temperature sensor can be attached to high heat load 118, which measures temperature information for the load and transmits an electronic signal corresponding to the measured information. An optional temperature sensor can be adjacent to the outlet of evaporator 116 that measures and transmits information about the temperature of the refrigerant fluid as it emerges from evaporator 116.

In certain embodiments, the systems disclosed herein are configured to determine superheat information for the refrigerant fluid based on temperature and pressure information for the refrigerant fluid measured by any of the sensors disclosed herein. The superheat of the refrigerant vapor refers to the difference between the temperature of the refrigerant fluid vapor at a measurement point in a TMS and the saturated vapor temperature of the refrigerant fluid defined by the refrigerant pressure at the measurement point in the thermal management a TMS.

To determine the superheat associated with the refrigerant fluid, the system control system 999 (as described) receives information about the refrigerant fluid vapor pressure after emerging from a heat exchanger downstream from evaporator 116, and uses calibration information, a lookup table, a mathematical relationship, or other information to determine the saturated vapor temperature for the refrigerant fluid from the pressure information. The control system 999 also receives information about the actual temperature of the refrigerant fluid, and then calculates the superheat associated with the refrigerant fluid as the difference between the actual temperature of the refrigerant fluid and the saturated vapor temperature for the refrigerant fluid.

The foregoing temperature sensors can be implemented in a variety of ways in a TMS. As one example, thermocouples and thermistors can function as temperature sensors in a TMS. Examples of suitable commercially available temperature sensors for use in a TMS include, but are not limited to, the 88000 series thermocouple surface probes (available from OMEGA Engineering Inc., Norwalk, Conn.).

A TMS can include a vapor quality sensor that measures vapor quality of the refrigerant fluid emerging from evaporator 116. Typically, such a sensor is implemented as a capacitive sensor that measures a difference in capacitance between the liquid and vapor phases of the refrigerant fluid. The capacitance information can be used to directly determine the vapor quality of the refrigerant fluid (e.g., by control system 999). Alternatively, sensor can determine the vapor quality directly based on the differential capacitance measurements and transmit an electronic signal that includes information about the refrigerant fluid vapor quality. Examples of commercially available vapor quality sensors that can be used in a TMS include, but are not limited to, HBX sensors (available from HB Products, Hasselager, Denmark).

It should generally be understood that the systems disclosed herein can include a variety of combinations of the various sensors described above, and control system 999 can receive measurement information periodically or aperiodically from any of the various sensors. Moreover, it should be understood any of the sensors described can operate autonomously, measuring information and transmitting the information to control system 999 (or directly to the first and/or second control device) or, alternatively, any of the sensors described above can measure information when activated by control system 999 via a suitable control signal, and measure and transmit information to control system 999 in response to the activating control signal.

To adjust a control device on a particular value of a measured system parameter value, control system 999 compares the measured value to a set point value (or threshold value) for the system parameter. Certain set point values represent a maximum allowable value of a system parameter, and if the measured value is equal to the set point value (or differs from the set point value by 10% or less (e.g., 5% or less, 3% or less, 1% or less) of the set point value), control system 999 adjusts a respective control device to modify the operating state of a TMS. Certain set point values represent a minimum allowable value of a system parameter, and if the measured value is equal to the set point value (or differs from the set point value by 10% or less (e.g., 5% or less, 3% or less, 1% or less) of the set point value), control system 999 adjusts the respective control device to modify the operating state of a TMS, and increase the system parameter value. The control system 999 executes algorithms that use the measured sensor value(s) to provide signals that cause the various control devices to adjust refrigerant flow rates, etc.

Some set point values represent "target" values of system parameters. For such system parameters, if the measured parameter value differs from the set point value by 1% or more (e.g., 3% or more, 5% or more, 10% or more, 20% or more), control system 999 adjusts the respective control device to adjust the operating state of the system, so that the system parameter value more closely matches the set point value.

Optional pressure sensors are configured to measure information about the pressure differential $p_r - p_e$ across a control device and to transmit an electronic signal corresponding to the measured pressure difference information. Two sensors can effectively measure $p_r$, $p_e$. In certain embodiments two sensors can be replaced by a single pressure differential sensor. Where a pressure differential sensor is used, a first end of the sensor is connected upstream of a first expansion device (i.e., expansion valve 114) and a second end of the sensor is connected downstream from the first expansion device.

System also includes optional pressure sensors positioned at the inlet and outlet, respectively, of evaporator 116. A sensor measures and transmits information about the refrigerant fluid pressure upstream from evaporator 116, and a sensor measure and transmit information about the refrigerant fluid pressure downstream from evaporator 116. This information can be used (e.g., by a system controller) to calculate the refrigerant fluid pressure drop across evaporator 116. As above, in certain embodiments, sensors can be replaced by a single pressure differential sensor to measure and transmit the refrigerant fluid pressure drop across evaporator 116.

To measure the evaporating pressure ($p_e$) a sensor can be optionally positioned between the inlet and outlet of evaporator 116, i.e., internal to evaporator 116. In such a configuration, the sensor can provide a direct a direct measurement of the evaporating pressure.

To measure refrigerant fluid pressure at other locations within system, sensor can also optionally be positioned, for example, in-line along a conduit. Pressure sensors at each of these locations can be used to provide information about the refrigerant fluid pressure downstream from evaporator 116, or the pressure drop across evaporator 116.

It should be appreciated that, in the foregoing discussion, any one or various combinations of two sensors discussed in connection with system can correspond to the first measurement device connected to expansion valve 114, and any one or various combination of two sensors can correspond to the second measurement device. In general, as discussed previously, the first measurement device provides information corresponding to a first thermodynamic quantity to the first control device, and the second measurement device provides information corresponding to a second thermodynamic quantity to the second control device, where the first and second thermodynamic quantities are different, and therefore allow the first and second control device to independently control two different system properties (e.g., the vapor quality of the refrigerant fluid and the heat load temperature, respectively).

In some embodiments, one or more of the sensors shown in system are connected directly to expansion valve 114. The first and second control device can be configured to adaptively respond directly to the transmitted signals from the sensors, thereby providing for automatic adjustment of the system's operating parameters. In certain embodiments, the first and/or second control device can include processing hardware and/or software components that receive transmitted signals from the sensors, optionally perform computational operations, and activate elements of the first and/or second control device to adjust the control device in response to the sensor signals.

In addition, control system 999 is optionally connected to expansion valve 114. In embodiments where expansion valve 114 is implemented as a device controllable via an electrical control signal, control system 999 is configured to transmit suitable control signals to the first and/or second control device to adjust the configuration of these components. In particular, control system 999 is configured to adjust expansion valve 114 to control the vapor quality of the refrigerant fluid in a TMS.

During operation of a TMS, control system 999 typically receives measurement signals from one or more sensors. The measurements can be received periodically (e.g., at consistent, recurring intervals) or irregularly, depending upon the nature of the measurements and the manner in which the measurement information is used by control system 999. In some embodiments, certain measurements are performed by control system 999 after particular conditions—such as a measured parameter value exceeding or falling below an associated set point value—are reached.

By way of example, Table 1 summarizes various examples of combinations of types of information (e.g., system properties and thermodynamic quantities) that can be measured by the sensors of system and transmitted to control system 999, to allow control system 999 to generate and transmit suitable control signals to expansion valve 114 and/or other control devices. The types of information shown in Table 1 can generally be measured using any suitable device (including combination of one or more of the sensors discussed herein) to provide measurement information to control system 999.

TABLE 1

| | | Measurement Information Used to Adjust First Control Device | | | | | | | |
|---|---|---|---|---|---|---|---|---|---|
| | | Press Drop | Evap Press Drop | Rec Pres | VQ | SH | Evap VQ | Evap P/T | HL Temp |
| Measurement Information Used to Adjust Control Device | Press Drop | | | | | | | x | x |
| | Evap Press Drop | | | | | | | x | x |
| | Rec Press | | | | | | | x | x |
| | VQ | | | | | | | x | x |
| | SH | | | | | | | x | x |
| | Evap VQ | | | | | | | x | x |
| | Evap P/T | x | x | x | x | x | x | | x |
| | HL Temp | x | x | x | x | x | x | x | |

Press Drop = refrigerant fluid pressure drop across control device (expansion valve 114)
Evap Press Drop = refrigerant fluid pressure drop across evaporator
Rec Press = refrigerant fluid pressure in receiver
VQ = vapor quality of refrigerant fluid
SH = superheat of refrigerant fluid
Evap VQ = vapor quality of refrigerant fluid at evaporator outlet
Evap P/T = evaporation pressure or temperature
HL Temp = heat load temperature For example, in some embodiments, expansion valve 114 is adjusted (e.g., automatically or by control system 999) based on a measurement of the evaporation pressure ($p_e$) of the refrigerant fluid and/or a measurement of the evaporation temperature of the refrigerant fluid. In certain embodiments, expansion valve 114 is adjusted (e.g., automatically or by control system 999) based on a measurement of the temperature of heat load 118.

To adjust any of the control devices, compressor (if variable), or pump based on a particular value of a measured system parameter value, control system 999 compares the measured value to a set point value (or threshold value) for the system parameter. Certain set point values represent a maximum allowable value of a system parameter, and if the measured value is equal to the set point value (or differs from the set point value by 10% or less (e.g., 5% or less, 3% or less, 1% or less) of the set point value), control system 999 adjusts, e.g., the expansion valve 114, etc. to adjust the operating state of the system, and reduce the system parameter value.

Certain set point values represent a minimum allowable value of a system parameter, and if the measured value is equal to the set point value (or differs from the set point value by 10% or less (e.g., 5% or less, 3% or less, 1% or less) of the set point value), control system 999 adjusts, e.g., the expansion valve 114, etc. to adjust the operating state of the system, and increase the system parameter value.

Some set point values represent "target" values of system parameters. For such system parameters, if the measured parameter value differs from the set point value by 1% or more (e.g., 3% or more, 5% or more, 10% or more, 20% or more), control system 999 adjusts, e.g., the expansion valve 114, etc. to adjust the operating state of the system, so that the system parameter value more closely matches the set point value.

Measured parameter values are assessed in relative terms based on set point values (i.e., as a percentage of set point values). Alternatively, in some embodiments, measured parameter values can be accessed in absolute terms. For example, if a measured system parameter value differs from a set point value by more than a certain amount (e.g., by 1 degree C. or more, 2 degrees C. or more, 3 degrees C. or more, 4 degrees C. or more, 5 degrees C. or more), then control system 999 adjusts expansion valve 114, etc. to adjust the operating state of the system, so that the measured system parameter value more closely matches the set point value.

In the foregoing examples, measured parameter values are assessed in relative terms based on set point values (i.e., as a percentage of set point values). Alternatively, in some embodiments, measured parameter values can be in absolute terms. For example, if a measured system parameter value differs from a set point value by more than a certain amount (e.g., by 1 degree C. or more, 2 degrees C. or more, 3 degrees C. or more, 4 degrees C. or more, 5 degrees C. or more), then control system 999 adjusts expansion valve 114, etc. to adjust the operating state of the system, so that the measured system parameter value more closely matches the set point value.

In certain embodiments, refrigerant fluid emerging from evaporator 116 can be used to cool one or more additional heat loads. In addition, systems can include a second heat load connected to a heat exchanger. A variety of mechanical connections can be used to attach second heat load to heat exchanger, including (but not limited to) brazing, clamping, welding, and any of the other connection types discussed herein.

Heat exchanger includes one or more flow channels through which high vapor quality refrigerant fluid flows after leaving evaporator 116. During operation, as the refrigerant fluid vapor phases through the flow channels, it absorbs heat energy from high heat load 118, cooling the high heat load 118.

In general, the systems disclosed herein can include more than one (e.g., two or more, three or more, four or more, five or more, or even more) heat loads in addition to heat loads depicted. Each of the additional heat loads can have an associated heat exchanger; in some embodiments, multiple additional heat loads are connected to a single heat exchanger, and in certain embodiments, each additional heat load has its own heat exchanger. Moreover, each of the additional heat loads can be cooled by the superheated refrigerant fluid vapor after a heat exchanger attached to the second load or cooled by the high vapor quality fluid stream that emerges from evaporator 116.

Although evaporator 116 and heat exchanger are implemented as separate components, in certain embodiments, these components can be integrated to form a single heat exchanger, with heat load and second heat load both connected to the single heat exchanger. The refrigerant fluid vapor that is discharged from the evaporator portion of the single heat exchanger is used to cool second heat load, which is connected to a second portion of the single heat exchanger.

The vapor quality of the refrigerant fluid after passing through evaporator 116 can be controlled either directly or indirectly with respect to a vapor quality set point by control system 999. In some embodiments, the system includes a vapor quality sensor that provides a direct measurement of vapor quality, which is transmitted to control system 999. Control system 999 adjusts control device depending on configuration to control the vapor quality relative to the vapor quality set point value.

In certain embodiments, the system includes a sensor that measures superheat and indirectly, vapor quality. For example, a combination of temperature and pressure sensors measure the refrigerant fluid superheat downstream from a second heat load, and transmit the measurements to control system 999. Control system 999 adjusts control device according to the configuration based on the measured superheat relative to a superheat set point value. By doing so, control system 999 indirectly adjusts the vapor quality of the refrigerant fluid emerging from evaporator 116.

Further, eliminating (or nearly eliminating) the refrigerant vapor from the refrigerant fluid stream entering evaporator 116 can help to reduce the cross-section of the evaporator and improve film boiling in the refrigerant channels. In film boiling, the liquid phase (in the form of a film) is physically separated from the walls of the refrigerant channels by a layer of refrigerant vapor, leading to poor thermal contact and heat transfer between the refrigerant liquid and the refrigerant channels. Reducing film boiling improves the efficiency of heat transfer and the cooling performance of evaporator 116.

In addition, by eliminating (or nearly eliminating) the refrigerant vapor from the refrigerant fluid stream entering evaporator 116, distribution of the liquid refrigerant within the channels of evaporator 116 can be made easier. In certain embodiments, vapor present in the refrigerant channels of evaporator 116 can oppose the flow of liquid refrigerant into the channels. Diverting the vapor phase of the refrigerant fluid before the fluid enters evaporator 116 can help to reduce this difficulty.

In addition to phase separator, or as an alternative to phase separator, in some embodiments the systems disclosed herein can include a phase separator downstream from evaporator 116. Such a configuration can be used when the refrigerant fluid emerging from evaporator is not entirely in the vapor phase, and still includes liquid refrigerant fluid.

The foregoing examples of thermal management systems illustrate a number of features that can be included in any of the systems within the scope of this disclosure. In addition, a variety of other features can be present in such systems.

In certain embodiments, refrigerant fluid that is discharged from evaporator 116 and passes through conduit can be directly discharged as exhaust from conduit without further treatment. Direct discharge provides a convenient and straightforward method for handling spent refrigerant, and has the added advantage that over time, the overall weight of the system is reduced due to the loss of refrigerant fluid. For systems that are mounted to small vehicles or are otherwise mobile, this reduction in weight can be important.

In some embodiments, however, refrigerant fluid vapor can be further processed before it is discharged. Further processing may be desirable depending upon the nature of the refrigerant fluid that is used, as direct discharge of unprocessed refrigerant fluid vapor may be hazardous to humans and/or may be deleterious to mechanical and/or electronic devices in the vicinity of a TMS. For example, the unprocessed refrigerant fluid vapor may be flammable or toxic, or may corrode metallic device components. In situations such as these, additional processing of the refrigerant fluid vapor may be desirable.

In general, a refrigerant processing apparatus can be implemented in various ways. In some embodiments, a refrigerant processing apparatus is a chemical scrubber or water-based scrubber. Within the apparatus, the refrigerant fluid is exposed to one or more chemical agents that treat the refrigerant fluid vapor to reduce its deleterious properties. For example, where the refrigerant fluid vapor is basic (e.g., ammonia) or acidic, the refrigerant fluid vapor can be exposed to one or more chemical agents that neutralize the vapor and yield a less basic or acidic product that can be collected for disposal or discharged from the apparatus.

As another example, where the refrigerant fluid vapor is highly chemically reactive, the refrigerant fluid vapor can be exposed to one or more chemical agents that oxidize, reduce, or otherwise react with the refrigerant fluid vapor to yield a less reactive product that can be collected for disposal or discharged from the apparatus.

In certain embodiments, a refrigerant processing apparatus can be implemented as an adsorptive sink for the refrigerant fluid. The apparatus can include, for example, an adsorbent material bed that binds particles of the refrigerant fluid vapor, trapping the refrigerant fluid within apparatus and preventing discharge. The adsorptive process can sequester the refrigerant fluid particles within the adsorbent material bed, which can then be removed from apparatus and sent for disposal.

In some embodiments, where the refrigerant fluid is flammable, a refrigerant processing apparatus can be implemented as an incinerator. Incoming refrigerant fluid vapor can be mixed with oxygen or another oxidizing agent and ignited to combust the refrigerant fluid. The combustion products can be discharged from the incinerator or collected (e.g., via an adsorbent material bed) for later disposal.

As an alternative, the refrigerant processing apparatus can also be implemented as a combustor of an engine or another mechanical power-generating device. Refrigerant fluid vapor from conduit can be mixed with oxygen, for example, and combusted in a piston-based engine or turbine to perform mechanical work, such as providing drive power for a vehicle or driving a generator to produce electricity. In certain embodiments, the generated electricity can be used to provide electrical operating power for one or more devices, including high heat load 118. For example, high heat load 118 can include one or more electronic devices that are powered, at least in part, by electrical energy generated from combustion of refrigerant fluid vapor in the refrigerant processing apparatus.

The thermal management systems disclosed herein can optionally include a phase separator upstream from the refrigerant processing apparatus.

Particularly during start-up of the systems disclosed herein, liquid refrigerant may be present in conduits because the systems generally begin operation before high heat load 118 is activated. Accordingly, phase separator functions in a manner similar to phase separators to separate liquid refrigerant fluid from refrigerant vapor. The separated liquid refrigerant fluid can be re-directed to another portion of the system, or retained within phase separator until it is converted to refrigerant vapor. By using a phase separator, liquid refrigerant fluid can be prevented from entering the refrigerant processing apparatus.

In some embodiments, the refrigeration systems disclosed herein can be combined with power systems to form integrated power and thermal systems, in which certain components of the integrated systems are responsible for providing refrigeration functions and certain components of the integrated systems are responsible for generating operating power.

Figure 9:
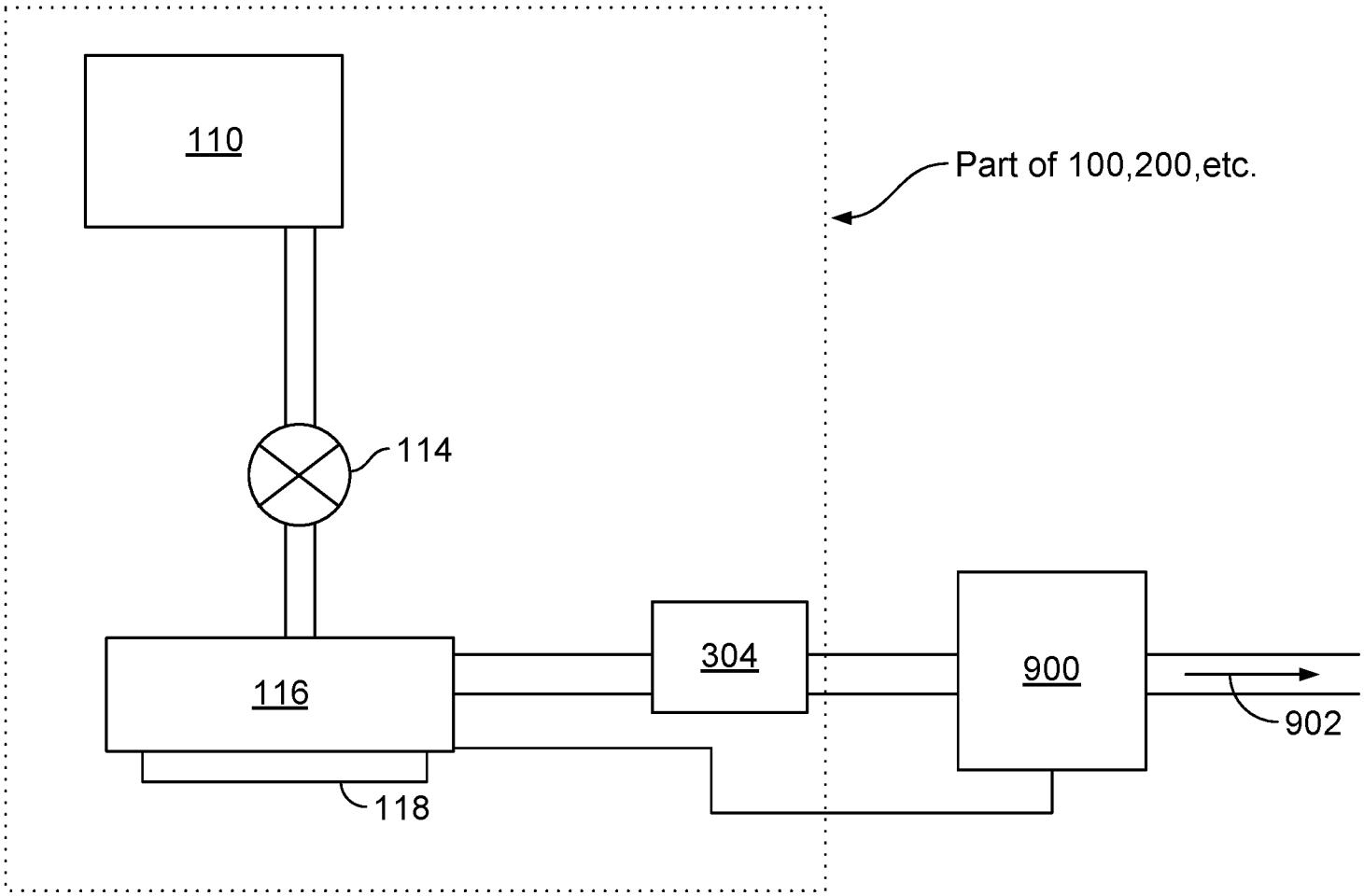
FIG. 9 is a schematic diagram of an example of a thermal management system that includes a power generation apparatus according to the present disclosure.

FIG. 9 shows an integrated power and a TMS that includes many features similar to those discussed above (e.g., see FIG. 1A). In addition, a TMS includes an engine 900 with an inlet that receives the stream of waste refrigerant fluid. Engine 900 can combust the waste refrigerant fluid directly, or alternatively can mix the waste refrigerant fluid with one or more additives (such as oxidizers) before combustion. Where ammonia is used as the refrigerant fluid in a TMS, suitable engine configurations for both direct ammonia combustion as fuel, and combustion of ammonia mixed with other additives, can be implemented. In general, combustion of ammonia improves the efficiency of power generation by the engine.

The energy released from combustion of the refrigerant fluid can be used by engine 900 to generate electrical power, e.g., by using the energy to drive a generator. The electrical power can be delivered via electrical connection to high heat load 118 to provide operating power for the high heat load 118. For example, in certain embodiments, high heat load 118 includes one or more electrical circuits and/or electronic devices, and engine 900 provides operating power to the circuits/devices via combustion of refrigerant fluid. Byproducts 902 of the combustion process can be discharged from engine 900 via exhaust conduit, as shown in FIG. 9.

Various types of engines and power-generating devices can be implemented as engine 900 in a TMS. In some embodiments, for example, engine 900 is a conventional four-cycle piston-based engine, and the waste refrigerant fluid is introduced into a combustor of the engine. In certain embodiments, engine 900 is a gas turbine engine, and the waste refrigerant fluid is introduced via the engine inlet to the afterburner of the gas turbine engine. As discussed above, in some embodiments, a TMS can include phase separator (not shown) positioned upstream from engine 900. Phase separator functions to prevent liquid refrigerant fluid from entering engine 900, which may reduce the efficiency of electrical power generation by engine 900.

In certain embodiments, the thermal management systems disclosed herein operate differently at, and immediately following, system start-up, compared to the manner in which the systems operate after an extended running period. Upon start-up, the compressor 104 and a device (usually a fan) moving a cooling fluid (usually ambient air) through the condenser 106 are powered. The compressor 104 discharges compressed refrigerant into the condenser 106. The refrigerant is condensed and subcooled in the condenser 106. Liquid refrigerant fluid enters receiver 110 at a pressure and temperature generated by operation of the compressor 104 and condenser 106.

The thermal management systems and methods disclosed herein can be implemented as part of (or in conjunction with) directed energy systems such as high energy laser systems. Due to their nature, directed energy systems typically present a number of cooling challenges, including certain heat loads for which temperatures are maintained during operation within a relatively narrow range.

Figure 10:
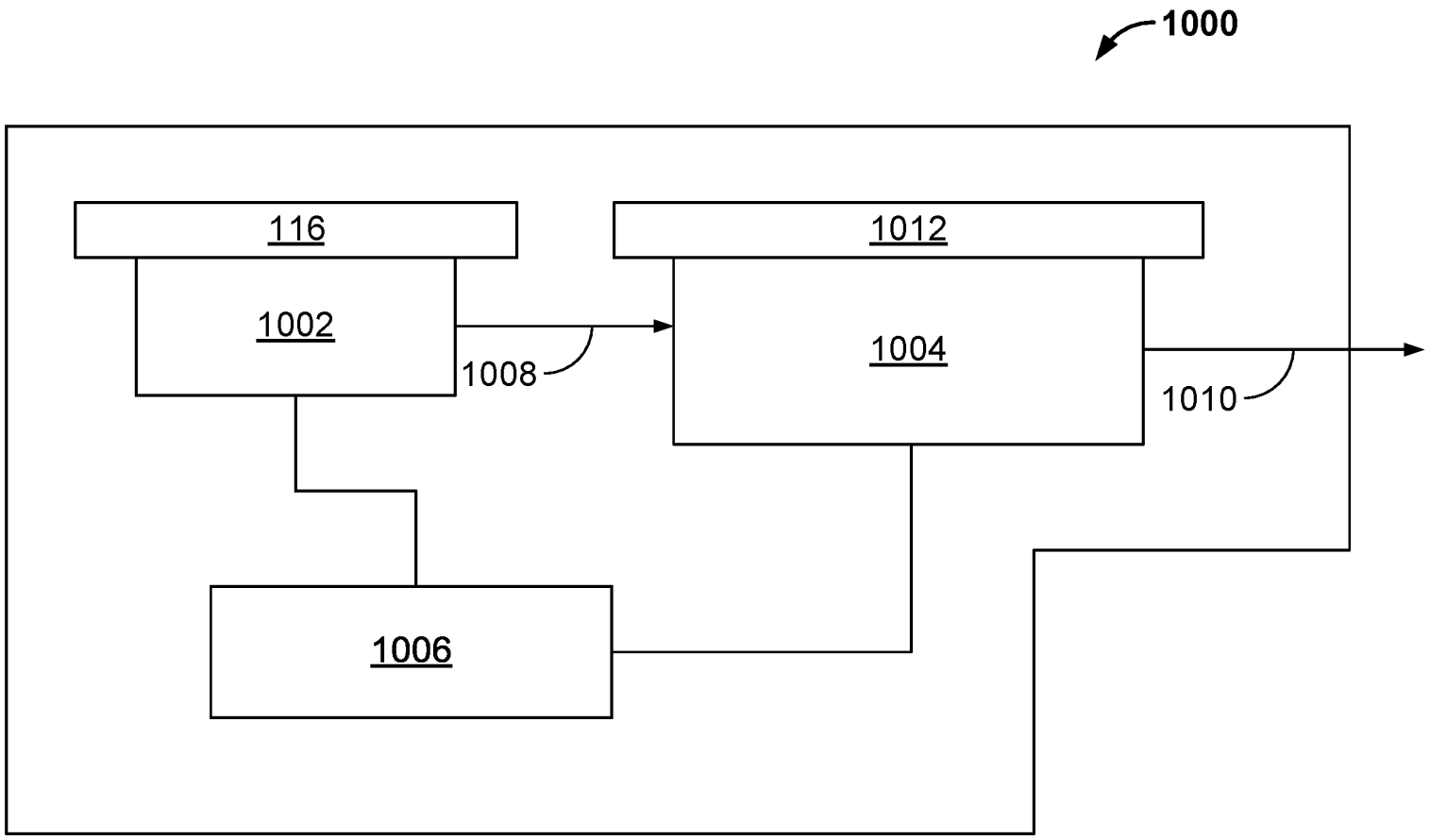
FIG. 10 is a schematic diagram of an example of directed energy system that includes a thermal management system according to the present disclosure.

FIG. 10 shows one example of a directed energy system, specifically, a high energy laser system 1000. System 1000 includes a bank of one or more laser diodes 1002 and an amplifier 1004 connected to a power source 1006. During operation, laser diodes 1002 generate an output radiation beam 1008 that is amplified by amplifier 1004, and directed as output beam 1010 onto a target. Generation of high energy output beams can result in the production of significant quantities of heat. Certain laser diodes, however, are relatively temperature sensitive, and the operating temperature of such diodes is regulated within a relatively narrow range of temperatures to ensure efficient operation and avoid thermal damage. Amplifiers are also temperature-sensitively, although typically less sensitive than diodes.

To regulate the temperatures of various components of directed energy systems such as diodes 1002 and amplifier 1004, such systems can include components and features of the thermal management systems disclosed herein. In FIG. 10, evaporator 116 (FIGS. 1A, etc.) is coupled to diodes 1002, while a heat exchanger 1012 (which can be evaporator 116) is coupled to amplifier 1004. The other components of the thermal management systems disclosed herein are not shown for clarity. However, it should be understood that any of the features and components discussed above can optionally be included in directed energy systems. Diodes 1002, due to their temperature-sensitive nature, effectively function as high heat load 118 in system 1000 and/or diodes and amplifier 1004 functions as high heat load 118.

System 1000 is one example of a directed energy system that can include various features and components of the thermal management systems and methods described herein. However, it should be appreciated that the thermal management systems and methods are general in nature, and can be applied to cool a variety of different heat loads under a wide range of operating conditions.

Control system 999 can generally be implemented as any one of a variety of different electrical or electronic computing or processing devices, and can perform any combination of the various steps discussed above to control various components of the disclosed thermal management systems.

Control system 999 can generally, and optionally, include any one or more of a processor (or multiple processors), a memory, a storage device, and input/output device. Some or all of these components can be interconnected using a system bus. The processor is capable of processing instructions for execution. In some embodiments, the processor is a single-threaded processor. In certain embodiments, the processor is a multi-threaded processor. Typically, the processor is capable of processing instructions stored in the memory or on the storage device to display graphical information for a user interface on the input/output device, and to execute the various monitoring and control functions discussed above. Suitable processors for the systems disclosed herein include both general and special purpose microprocessors, and the sole processor or one of multiple processors of any kind of computer or computing device.

The memory stores information within the system, and can be a computer-readable medium, such as a volatile or non-volatile memory. The storage device can be capable of providing mass storage for the control system 999. In general, the storage device can include any non-transitory tangible media configured to store computer readable instructions. For example, the storage device can include a computer-readable medium and associated components, including: magnetic disks, such as internal hard disks and removable disks; magneto-optical disks; and optical disks. Storage devices suitable for tangibly embodying computer program instructions and data include all forms of non-volatile memory including by way of example, semiconductor memory devices, such as EPROM, EEPROM, and flash memory devices; magnetic disks such as internal hard disks and removable disks; magneto-optical disks; and CD-ROM and DVD-ROM disks. Processors and memory units of the systems disclosed herein can be supplemented by, or incorporated in, ASICs (application-specific integrated circuits).

The input/output device provides input/output operations for control system 999, and can include a keyboard and/or pointing device. In some embodiments, the input/output device includes a display unit for displaying graphical user interfaces and system related information.

The features described herein, including components for performing various measurement, monitoring, control, and communication functions, can be implemented in digital electronic circuitry, or in computer hardware, firmware, or in combinations of them. Methods steps can be implemented in a computer program product tangibly embodied in an information carrier, e.g., in a machine-readable storage device, for execution by a programmable processor (e.g., of control system 999), and features can be performed by a programmable processor executing such a program of instructions to perform any of the steps and functions described above. Computer programs suitable for execution by one or more system processors include a set of instructions that can be used directly or indirectly, to cause a processor or other computing device executing the instructions to perform certain activities, including the various steps discussed above.

Computer programs suitable for use with the systems and methods disclosed herein can be written in any form of programming language, including compiled or interpreted languages, and can be deployed in any form, including as stand-alone programs or as modules, components, subroutines, or other units suitable for use in a computing environment.

In addition to one or more processors and/or computing components implemented as part of control system 999, the systems disclosed herein can include additional processors and/or computing components within any of the control device (e.g., expansion valve 114) and any of the sensors discussed above. Processors and/or computing components of the control devices and sensors, and software programs and instructions that are executed by such processors and/or computing components, can generally have any of the features discussed above in connection with control system 999.

A number of embodiments have been described. Nevertheless, it will be understood that various modifications may be made without departing from the spirit and scope of the disclosure. Accordingly, other embodiments are within the scope of the following claims.

What is claimed is:

1. A thermal management system, comprising:

a receiver configured to store a refrigerant fluid;

a refrigeration system comprising a refrigerant fluid path that comprises the receiver, with the refrigeration system configured to receive the refrigerant fluid from the receiver through the refrigerant fluid path;

at least one first evaporator disposed in the refrigerant fluid path and configured to receive the refrigerant fluid and to extract heat from at least one heat load having a specified thermal inertia that is in at least one of thermal conductive or convective contact with the at least one first evaporator;

a suction accumulator comprising a suction accumulator inlet and a vapor-side outlet, the suction accumulator inlet coupled to an outlet of the at least one first evaporator and the vapor-side outlet coupled to a compressor inlet of a compressor;

a hot vapor circuit disposed to bypass a portion of the refrigeration system, the hot vapor circuit comprising:

a solenoid valve comprising an inlet and an outlet, a first junction, and a second junction, with the first junction and the second junction coupling the solenoid valve into the refrigeration system;

a first expansion valve comprising an inlet and an outlet, with the inlet coupled to the outlet of the solenoid valve; and at least one additional evaporator comprising an inlet and an outlet, with the inlet of the at least one additional evaporator coupled to the outlet of the first expansion valve and the outlet of the at least one additional evaporator coupled to the suction accumulator inlet.

2. The system of claim 1, wherein the refrigerant fluid path further comprises:

the compressor comprising the compressor inlet and a compressor outlet;

the first junction comprising an inlet coupled to the compressor outlet, and further comprising first and second outlets; and a condenser comprising a condenser inlet coupled to the first outlet of the first junction, and having a condenser outlet coupled to an inlet of the receiver, the condenser configured to condense a superheated vapor at the condenser inlet by removing heat from the condensed, superheated vapor, and is bypass-able by operation of the hot vapor circuit.

3. The system of claim 2, wherein the solenoid valve is coupled to the second outlet of the first junction.

4. The system of claim 2, wherein the suction accumulator is configured to receive the refrigerant fluid as a saturated or superheated vapor from the at least one first evaporator.

5. The system of claim 1, further comprising at least one flow control device comprising an inlet coupled to an outlet of the receiver and an outlet coupled to transport refrigerant fluid from the outlet of the receiver to an inlet of the at least one first evaporator.

6. The system of claim 5, wherein the flow control device is the first expansion valve configured to cause an adiabatic flash evaporation of a part of the refrigerant fluid received from the receiver.

7. The system of claim 6, wherein the second junction comprises an outlet coupled to the inlet of the at least one first evaporator, a first inlet coupled to the outlet of the first expansion valve and a second inlet coupled to the outlet of the solenoid valve.

8. The system of claim 6, wherein the second junction comprises an outlet coupled to the inlet of the first expansion valve, a first inlet coupled to the outlet of the receiver and a second inlet coupled to the outlet of the solenoid valve.

9. The system of claim 1, wherein the hot vapor circuit is configured to operate to supply heat to a heat load thermally coupled to or in proximity to the at least one first evaporator.

10. The system of claim 1, wherein the refrigeration system is configured to operate in at least one of three modes.

11. The system of claim 10, wherein a first mode is a heating mode, a second mode is a cooling mode, and a third mode is a combination of heating and cooling.

12. The system of claim 11, wherein the refrigeration system is configured to further operate in a fourth mode that is a standby mode and a fifth mode that is a pump down mode.

13. The system of claim 1, wherein the first expansion valve is one of a plurality of expansion valves comprising inlets coupled to a receiver outlet and outlets coupled to the inlets of the at least one first evaporator and the at least one additional evaporator, with the plurality of expansion valves configured to cause adiabatic flash evaporation of the refrigerant fluid received from the receiver.

14. The system of claim 2, wherein the section accumulator is a liquid separator comprising an inlet, a liquid-side outlet, and a vapor-side outlet.

15. The system of claim 14, further comprising an ejector comprising an ejector inlet, a secondary inlet, and an ejector outlet.

16. The system of claim 15, wherein the first expansion valve is coupled between an outlet of the receiver and the inlet of the ejector and configured to control a flow of the refrigerant fluid from the receiver to the ejector and to cause an adiabatic flash evaporation of a part of the refrigerant fluid received from the receiver.

17. The system of claim 14, wherein an inlet of the at least one first evaporator is coupled to the liquid-side outlet and an outlet of the at least one first evaporator is coupled to the secondary inlet of the ejector.

18. The system of claim 14, wherein an inlet of the at least one first evaporator is coupled to the ejector outlet and an outlet of the at least one first evaporator is coupled to the liquid-side outlet of the liquid separator.

19. The system of claim 14, further comprising a pump comprising a pump inlet and a pump outlet.

20. The system of claim 19, wherein the first expansion valve is coupled between an outlet of the receiver and the inlet of the liquid separator and configured to control a flow of the refrigerant fluid from the receiver to the liquid separator and to cause an adiabatic flash evaporation of a part of the refrigerant fluid received from the receiver.

21. The system of claim 20, wherein the pump inlet is coupled to the liquid-side outlet and the pump outlet is coupled to an inlet of the at least one first evaporator.

22. The system of claim 20, wherein an inlet of the at least one first evaporator is coupled to the pump outlet and an outlet of the at least one evaporator is coupled to the inlet of the liquid separator.

23. The system of claim 22, further comprising a third junction to couple the inlet of the at least one first evaporator to the pump outlet and the outlet of the at least one first evaporator to the inlet of the liquid separator.

24. The system of claim 19, wherein the inlet of the first expansion valve is coupled to an outlet of the receiver and the outlet of the first expansion valve is coupled to an inlet of the at least one first evaporator, the first expansion valve configured to control a flow of the refrigerant fluid from the receiver to the at least one first evaporator and to cause an adiabatic flash evaporation of a part of the refrigerant fluid received from the receiver.

25. The system of claim 24, wherein the expansion valve is a first expansion valve, and the hot vapor circuit further comprises:

a second expansion valve comprising an inlet coupled to the outlet of the solenoid valve and an outlet coupled to the inlet of the at least one first evaporator, the second expansion valve configured to control a flow of the refrigerant fluid from the compressor outlet to the at least one evaporator and to cause an adiabatic flash evaporation of a part of the refrigerant fluid received from the compressor outlet.

26. The system of claim 24, wherein the pump inlet is coupled to the liquid-side outlet and the pump outlet is coupled to the inlet of the at least one first evaporator.

27. The system of claim 24, wherein the inlet of the at least one first evaporator is further coupled to the pump outlet and an outlet of the at least one first evaporator is coupled to the inlet of the liquid separator.

28. The system of claim 27, further comprising third and fourth junctions to couple the inlet of the at least one first evaporator to the pump outlet.

29. The system of claim 6, wherein the first expansion valve is configured to control a vapor quality of the refrigerant fluid at an outlet of the at least one first evaporator.

30. The system of claim 29, wherein the vapor quality is in a range of 0.5 up to 1.0, 0.6 up to 0.95, or 0.8 up to 0.85.

31. The system of claim 29, wherein the vapor quality is in a range of 0.5 up to 1.0, 0.6 up to 0.95, or 0.8 up to 0.85.

32. The system of claim 1, wherein the refrigerant fluid comprises ammonia.

33. A thermal management method, comprising:

transporting a refrigerant fluid through a refrigeration system having a refrigerant fluid path with a receiver and at least one first evaporator that is in at least one of thermal conductive or convective contact with at least one heat load having a specified thermal inertia;

removing heat from the at least one heat load with the refrigerant fluid transported to the at least one first evaporator;

transporting the refrigerant fluid to a suction accumulator inlet of a suction accumulator coupled to an outlet of the at least one first evaporator and from a vapor-side outlet of the suction accumulator and to a compressor inlet of a compressor of the refrigeration system;

bypassing a portion of the refrigerant fluid from the refrigeration system through a hot vapor circuit that comprises a solenoid valve comprising an inlet and an outlet, a first junction, and a second junction, with the first junction and the second junction coupling the solenoid valve into the refrigeration system;

transporting the refrigerant fluid to from the outlet of the solenoid valve to an inlet of a first expansion valve and through an outlet of the first expansion valve; and transporting the refrigerant fluid from an outlet of the first expansion valve to an inlet of an at least one additional evaporator and through an outlet of the at least one additional evaporator to the suction accumulator inlet.

34. The method of claim 33, further comprising adding heat to the heat load with the at least one evaporator by transporting at least a portion of the refrigerant fluid through the hot vapor circuit.

35. The method of claim 34, wherein transporting the portion through the hot vapor circuit is a first mode of operation, and the method further comprises extracting the heat from the heat load in contact with the at least one evaporator during a second mode of operation.

36. The method of claim 33, further comprising controlling the refrigerant fluid received from the receiver to the at least one first evaporator with the first expansion valve that is disposed in the refrigerant fluid path.

37. The method of claim 34, further comprising separating a saturated vapor fraction of the refrigerant fluid from a liquid fraction of the refrigerant fluid received from the at least one first evaporator.

38. The method of claim 37, further comprising:

compressing a saturated vapor received from the suction accumulator into a superheated vapor;

condensing the superheated vapor into a refrigerant liquid by removing heat from the superheated vapor in the second mode of operation; and delivering the refrigerant liquid to the receiver.

39. The method of claim 35, further comprising regulating operation between the first and second modes by controlling operation of the solenoid valve in the hot vapor circuit.

40. The method of claim 33, wherein the refrigerant comprises ammonia.

41. A thermal management system, comprising:

a receiver configured to store a refrigerant fluid;

a refrigeration system comprising a refrigerant fluid path that comprises the receiver, with the refrigeration system configured to receive the refrigerant fluid from the receiver through the refrigerant fluid path;

at least one evaporator disposed in the refrigerant fluid path and configured to receive the refrigerant fluid and to extract heat from at least one heat load having a specified thermal inertia that is in at least one of thermal conductive or convective contact with the at least one evaporator;

a hot vapor circuit disposed to bypass a portion of the refrigeration system;

a compressor comprising a compressor inlet and a compressor outlet;

a junction comprising an inlet coupled to the compressor outlet, and further comprising first and second outlets;

a condenser comprising a condenser inlet coupled to the first outlet of the junction and a condenser outlet coupled to an inlet of the receiver, the condenser configured to condense a superheated vapor at the condenser inlet by removing heat from the condensed, superheated vapor, and is bypass-able by operation of the hot vapor circuit;

a liquid separator comprising an inlet, a liquid-side outlet, and a vapor-side outlet; and a pump comprising a pump inlet and a pump outlet.

42. The system of claim 41, wherein the hot vapor circuit includes a solenoid valve.

43. The system of claim 41, wherein the hot vapor circuit comprises:

a solenoid valve having an inlet and an outlet;

a first junction; and a second junction, with the first junction and the second junction coupling the solenoid valve into the refrigeration system.

44. The system of claim 41, further comprising a suction accumulator comprising a suction accumulator inlet and a vapor-side outlet, the suction accumulator inlet coupled to an outlet of the at least one evaporator and the vapor-side outlet coupled to the compressor inlet.

45. The system of claim 43, further comprising a flow control device comprising an inlet coupled to an outlet of the receiver and an outlet coupled to transport refrigerant fluid from the receiver outlet to an inlet of the at least one evaporator.

46. The system of claim 45, wherein the flow control device is an expansion valve configured to cause an adiabatic flash evaporation of a part of refrigerant fluid received from the receiver.

47. The system of claim 46, wherein the second junction comprises an outlet coupled to an inlet of the at least one evaporator, a first inlet coupled to the outlet of the expansion valve and a second inlet coupled to the outlet of the solenoid valve.

48. The system of claim 46, wherein the second junction comprises an outlet coupled to the inlet of the expansion valve, a first inlet coupled to the outlet of the receiver, and a second inlet coupled to the outlet of the solenoid valve.

49. The system of claim 42, wherein the hot vapor circuit is configured to operate to supply heat to a heat load thermally coupled to or in proximity to the at least one evaporator.

50. The system of claim 42, wherein the refrigeration system is configured to operate in one of three modes.

51. The system of claim 50, wherein a first mode is a heating mode, a second mode is a cooling mode, and a third mode that is a combination of heating and cooling.

52. The system of claim 51, wherein the refrigeration system is configured to operate in a fourth mode that is a standby mode and a fifth mode that is a pump down mode.

53. The system of claim 41, wherein the at least one evaporator is a first evaporator, and the system further comprises:

a first expansion valve having an inlet and an outlet, with the inlet coupled to the outlet of the solenoid valve; and at least one additional evaporator having an evaporator inlet and an evaporator outlet, with the evaporator inlet coupled to the outlet of the first expansion valve and the evaporator outlet coupled to the inlet of the suction accumulator.

54. The system of claim 53, wherein the first expansion valve is one of a plurality of expansion valves having inlets coupled to a receiver outlet and having outlets coupled to the inlets of the first evaporator and the at least one additional evaporator, with the plurality of expansion valves configured to cause adiabatic flash evaporation of refrigerant fluid received from the receiver.

55. The system of claim 41, further comprising an expansion valve coupled between an outlet of the receiver and the inlet of the liquid separator, the expansion valve configured to control a flow of the refrigerant fluid from the receiver to the liquid separator and to cause an adiabatic flash evaporation of a part of the refrigerant fluid received from the receiver.

56. The system of claim 55, wherein the pump inlet is coupled to the liquid-side outlet and the pump outlet is coupled to an inlet of the at least one evaporator.

57. The system of claim 55, wherein an inlet of the at least one evaporator is coupled to the pump outlet and an outlet of the at least one evaporator is coupled to the inlet of the liquid separator.

58. The system of claim 57, wherein the junction is a first junction, the system further comprising second and third junctions to couple the inlet of the at least one evaporator to the pump outlet and the outlet of the at least one evaporator to the inlet of the liquid separator.

59. The system of claim 41, further comprising an expansion valve having an inlet coupled to an outlet of the receiver and having an outlet coupled to an inlet of the at least one evaporator, the expansion valve configured to control a flow of the refrigerant fluid from the receiver to the at least one evaporator and to cause an adiabatic flash evaporation of a part of the refrigerant fluid received from the receiver.

60. The system of claim 59, wherein the hot vapor circuit further comprises:

a solenoid valve comprising an inlet coupled to the compressor outlet and an outlet; and a second expansion valve comprising an inlet coupled to the outlet of the solenoid valve and an outlet coupled to the inlet of the at least one evaporator, the second expansion valve configured to control a flow of the refrigerant fluid from the compressor outlet to the at least one evaporator and to cause an adiabatic flash evaporation of a part of the refrigerant fluid received from the compressor outlet.

61. The system of claim 59, wherein the pump inlet is coupled to the liquid- side outlet and the pump outlet is coupled to the inlet of the at least one evaporator.

62. The system of claim 59, wherein the inlet of the at least one evaporator is further coupled to the pump outlet and an outlet of the at least one evaporator is coupled to the inlet of the liquid separator.

63. The system of claim 62, wherein the junction is a first junction, the system further comprising second, third, and fourth junctions to couple the inlet of the at least one evaporator to the pump outlet.

64. The system of claim 46, wherein the expansion valve is configured to control a vapor quality of the refrigerant fluid at an outlet of the at least one evaporator.

65. The system of claim 41, wherein the refrigerant fluid comprises ammonia.

* * * * *